US006808870B2

(12) United States Patent
Sato et al.

(10) Patent No.: US 6,808,870 B2
(45) Date of Patent: Oct. 26, 2004

(54) LIGHT-SENSITIVE SILVER HALIDE GRAIN AND SILVER HALIDE EMULSION

(75) Inventors: Tadanobu Sato, Kanagawa (JP); Takahiro Matsuno, Kanagawa (JP); Masaru Takasaki, Kanagawa (JP); Tadashi Inaba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/251,775

(22) Filed: Sep. 23, 2002

(65) Prior Publication Data

US 2003/0194664 A1 Oct. 16, 2003

(30) Foreign Application Priority Data

Sep. 27, 2001 (JP) ..... P2001-296952
Sep. 27, 2001 (JP) ..... P2001-296953
Sep. 27, 2001 (JP) ..... P2001-297024

(51) Int. Cl.[7] ..... G03C 1/005; G03C 1/494

(52) U.S. Cl. ..... 430/567; 430/599; 430/604; 430/605

(58) Field of Search ..... 430/567, 599, 430/604, 605

(56) References Cited

U.S. PATENT DOCUMENTS 5,360,712 A 11/1994 Olm et al.
5,462,849 A * 10/1995 Kuromoto et al. ..... 430/567
5,478,715 A * 12/1995 Ohzeki et al. ..... 430/567
5,576,171 A * 11/1996 Olm et al. ..... 430/567
5,728,517 A * 3/1998 Bryant et al. ..... 430/567
2002/0098453 A1 * 7/2002 Sato et al. ..... 430/567
2002/0142255 A1 * 10/2002 Yamashita ..... 430/567

FOREIGN PATENT DOCUMENTS

EP 1 033 616 A1 9/2000
JP 2000-267215 9/2000

* cited by examiner

*Primary Examiner*—Geraldine Letscher
(74) *Attorney, Agent, or Firm*—Sughre Mion, PLLC

(57) ABSTRACT

A light-sensitive silver halide grain containing at least one metal complex, wherein when an a-axis, a b-axis and a c-axis of a silver halide crystal lattice are each established taking as an origin a central metal of the metal complex incorporated into the silver halide grain, the metal complex has in a ligand thereof a site which can form any bond of a covalent bond, a dative bond and an ionic bond, or a bond in a mixed form of these bonds with a silver ion on a lattice point which does not exist on any of the a-axis, the b-axis and the c-axis. The silver halide photographic material has no reciprocity failure over a wide range of exposure illuminations without desensitization and decrease of contrast on the low intensity side.

20 Claims, No Drawings

LIGHT-SENSITIVE SILVER HALIDE GRAIN AND SILVER HALIDE EMULSION

FIELD OF THE INVENTION

The present invention relates to a silver halide photographic material, and particularly to a silver halide photographic material using dopant technology, which has high sensitivity, high gradation and no reciprocity failure.

BACKGROUND OF THE INVENTION

As one of techniques for modifying silver halide grains to improve the entire performance of silver halide photographic materials so as to be expected, there is a technique of incorporating silver ions and materials other than halide ions (dopants) into the silver halide grains (a doping technique). In particular, many investigations have been conducted for the doping technique of transition metal ions. When the transition metal ions are introduced into the silver halide grains as dopants, it has generally been observed that the transition metal ions effectively change photographic properties even though they are added in an extremely slight amount.

In order to improve the photographic properties of silver halide emulsions more effectively, a technique has also been known in which the silver halide grains are doped with not only the transition metal ions but also transition metal complexes. Effects obtained by the doping technique are (1) increase of sensitivity, (2) improvement in reciprocity failure and (3) increase of contrast. For the purpose of obtaining a highly sensitized emulsion, a group VIII metal complex having a cyanide ion as a ligand is used as a dopant, as disclosed in Japanese Patent Laid-Open No. 20854/1990 and Japanese Patent Publication No. 113743/1995. A hexacyano complex having iron or aluminum as a central metal is an effective sensitizing dopant among others. In order to obtain a high gradation emulsion, there is used a technique using hexachlororuthenium, hexachlororhodium or hexachlororhenium as disclosed in Japanese Patent Laid-Open Nos. 184740/1988, 285941/1989, 20852/1990 and 20855/1990, or a technique using nitrosyl or thionitrosyl as a ligand of a transition metal complex as disclosed in European Patents 033642, 0606895 and 0610670.

On the other hand, iridium complexes are used in order to improve reciprocity failure, particularly high intensity reciprocity failure. Examples of silver halide grains doped with the iridium complexes are disclosed in Japanese Patent Laid-Open Nos. 285941/1989, 118583/1991, 213449/1992, 278940/1992, 66511/1993, 313277/1993, 82947/1994, 235995/1994, 72569/1995, 72576/1995, 202440/1999 and 295841/1999, and a fluoride ion, a chloride ion, a bromide ion, $H_2O$, cyano, nitrosyl and thionitrosyl are used as ligands of the iridium complexes. Further, U.S. Pat. No. 5,360,712 discloses dopant technology using organic compounds as ligands, and discloses an iridium complex ($IrCl_5$(thia)) having thiazole as a ligand, as a dopant for improving high intensity reciprocity failure.

The use of the iridium complexes as dopants like these examples effectively improves high intensity reciprocity failure. However, tries to completely improve the high intensity reciprocity failure in the conventional examples accompany desensitization and decrease of contrast on the low intensity side in all cases, so that it has been difficult to improve the reciprocity failure which occurs at a high illumination, while keeping the photographic characteristics on the low intensity side unchanged.

SUMMARY OF THE INVENTION

An object of the present invention is to provide a silver halide photographic material by dopant technology, in which no reciprocity failure occurs over a wide range of exposure illuminations without desensitization and decrease of contrast on the low intensity side. As in the present invention, there are provided:

(1) A light-sensitive silver halide grain containing at least one metal complex having in a ligand a site which can form any bond of a covalent bond, a dative bond and an ionic bond, or a bond in a mixed form of these bonds with a silver ion, wherein when an a-axis, a b-axis and a c-axis of a silver halide crystal lattice are each established taking as an origin a central metal of the metal complex incorporated into the silver halide grain, the site in the ligand can interact with the silver ion on a lattice point which does not exist on any of the a-axis, the b-axis and the c-axis;

(2) The light-sensitive silver halide grain described in (1), wherein the ligand is a ligand which has a volume of 220% to 300% based on the volume of a chloride ion $Cl^-$, and in which the distance from an atom in the ligand coordinated to the central metal of the metal complex to an atom in the ligand farthest away is 5.1 angstroms or less;

(3) The light-sensitive silver halide grain described in (2), wherein the ligand is a ligand which has a volume of 220% to 265% based on the volume of a chloride ion $Cl^-$, and in which the distance from an atom in the ligand coordinated to the central metal of the metal complex to an atom in the ligand farthest away is 4.7 angstroms or less;

(4) The light-sensitive silver halide grain described in (1), wherein the interactable site in the ligand is from 2.5 angstroms to 4.0 angstroms apart from the silver ion on the lattice point which does not exist on any of the a-axis, the b-axis and the c-axis;

(5) The light-sensitive silver halide grain described in (1), wherein the metal complex has at least one asymmetric ligand, and a substituent group in the ligand occupies a position of a silver ion adjacent to the asymmetric ligand;

(6) The light-sensitive silver halide grain described in (1), wherein the ionic conductivity of the silver halide grain at the time when the metal complex is incorporated into the silver halide grain in an amount of $1\times10^{-4}$ mol per mol of silver is 50 times or less that of the silver halide grain into which no metal ion or no metal complex is introduced;

(7) The light-sensitive silver halide grain described in (6), wherein the ionic conductivity of the silver halide grain at the time when the metal complex is incorporated into the silver halide grain in an amount of $1\times10^{-4}$ mol per mol of silver is 30 times or less that of the silver halide grain into which no metal ion or no metal complex is introduced;

(8) The light-sensitive silver halide grain described in (1), wherein the metal complex incorporated into the silver halide grain has a charge more positive than −3;

(9) The light-sensitive silver halide grain described in (1), wherein the silver halide grain has an illumination conversion time of 5 seconds or less;

(10) The light-sensitive silver halide grain described in (1), wherein the metal complex is a transition metal complex;

(11) The light-sensitive silver halide grain described in (1), wherein the ligand is an organic compound having 3 or less carbon atoms or an inorganic compound;

(12) The light-sensitive silver halide grain described in (1), wherein the metal complex is an iridium complex;

(13) The light-sensitive silver halide grain described in (1), wherein the metal complex contains at least one ligand selected from the group consisting of a thiadiazole compound, a thiatriazole compound, an oxadiazole compound and a triazole compound;

(14) The light-sensitive silver halide grain described in (1), wherein the ligand of the metal complex contains phosphorus;

(15) The light-sensitive silver halide grain described in (1), wherein the ligand of the metal complex has an N—C—S bond;

(16) The light-sensitive silver halide grain described in (1), wherein the silver halide grain is mainly composed of silver chloride;

(17) The light-sensitive silver halide grain described in (1), wherein the silver halide grain has a silver bromide-containing layer, and the metal complex is contained in the silver bromide-containing layer;

(18) The light-sensitive silver halide grain described in (17), wherein the silver bromide-containing layer has a silver bromide content of 5 mol % to 50 mol %;

(19) The light-sensitive silver halide grain described in (16), wherein the silver halide grain has a silver chloride content of 89 mol % to 99.7 mol %, a silver bromide content of 0.25 mol % to 10 mol %, and a silver iodide content of 0.05 mol % to 1 mol %; and

(20) A silver halide emulsion containing the light-sensitive silver halide grain described in (1).

DETAILED DESCRIPTION OF THE INVENTION

The present invention will be described in detail below.

The high intensity reciprocity failure of a silver halide photographic emulsion occurs by occurrence of latent image dispersion due to the generation of a large amount of photoelectrons in a silver halide grain in high intensity exposure. Accordingly, the high intensity reciprocity failure can be improved by allowing the silver halide grain to have the function of temporarily evacuating from a conduction band the photoelectrons generated in large amounts by the high intensity exposure, and releasing the photoelectrons again to the conduction band after a certain elapse of time. This corresponds to remaking of a state in the silver halide grain in the high intensity exposure to the same state as in the low intensity exposure. This function of temporarily evacuating the photoelectrons, that is to say, the function of temporarily trapping the photoelectrons can be realized by doping the silver halide grain with a transition metal complex (the dopant having such a function is called an electron-releasing dopant or an illumination conversion dopant, the average time from the exposure to the release of the photoelectrons trapped by the dopant is called electron-releasing time, and the shortest exposure time for which the same photographic properties as in the low intensity exposure are realized is called illumination conversion time). As the transition metal complex for improving the high intensity reciprocity failure, hexachloroiridium has hitherto been used. When hexachloroiridium is used, the photoelectrons generated by exposure are trapped in a lowest unoccupied molecular orbital of iridium, a central metal. After the photoelectrons stay in this orbital for a definite period of time, they are released again to a conduction band. Hexachloroiridium has the excellent function of temporarily evacuating the photoelectrons generated in large amounts. However, although the high intensity reciprocity failure is improved, an increase in sensitivity (latent image sensitization) depending on the time from exposure to development takes place, resulting in unstable photographic properties, because the residence time at an electron trapping level is long. Further, hexachloroiridium also has the desensitizing function at the same time. In contrast, $IrCl_5$(thia) mentioned above as an example can improve the reciprocity failure without occurrence of latent image sensitization because of its moderate electron-releasing time. However, $IrCl_5$(thia) has the function of decreasing contrast in the low intensity exposure, so that it is incomplete as a dopant for improving the reciprocity failure.

In order to obtain reciprocity law characteristics without latent image sensitization, it is necessary that the photoelectrons in the conduction band is once trapped in an iridium site, followed by releasing the photoelectrons to the conduction band again after an elapse of "moderate time". In order to release the photoelectrons trapped on the central metal of the complex incorporated into the grain to the conduction band again, a pass must be established through which the photoelectrons are released to the conduction band through any ligand joined to the central metal, and the electron transfer efficiency at this time determines the high intensity reciprocity law characteristics and latent image keeping quality. Considering that the poor electron transfer efficiency of hexachloroiridium is the cause of the prolonged electron-releasing time, in order to improve this, it is necessary to partly replace the chloride ions, the ligand, with another ligand having a higher electron transfer efficiency. At this time, it is preferred that any atom in the ligand and a silver ion in the grain form a bond of some kind. However, when a certain atom in the ligand and a silver ion on an extension of a line joining the central metal in the complex and a ligand atom form a bond, the electron trapping force becomes too strong, resulting in a largely desensitized emulsion. Accordingly, a ligand forming such a bond is unfavorable. In the present invention, it has been discovered that moderate electron trapping and electron-releasing are obtained by allowing a certain atom in the ligand and a silver ion on a lattice point which does not exist on an extension of a line joining the central metal and a ligand atom to interact with each other so as to form a very weak bond, thereby realizing good reciprocity law characteristics and good latent image keeping quality.

On the other hand, considering only electronic effects for improving the reciprocity failure over a wide range of exposure illuminations, the object thereof is attained by prolonging the residence time of the photoelectrons on iridium as long as possible insofar as the latent image keeping quality is not deteriorated. However, the prolongation of the residence time on iridium causes not only latent image sensitization but also inefficiencies such as desensitization and decrease of contrast. Only the improvements in the electronic effects are insufficient for inhibiting the desensitization and decrease of contrast, and it becomes necessary to make the grain structure in the vicinity of the dopant proper. This can be realized by selecting as the ligand other than halogen used for controlling the reciprocity law characteristics a ligand whose molecular size and form are fitted to a space into which the ligand is to be incorporated, as properly as possible, so as not to disturb the grain structure of the silver halide grain.

As seen from the existence of interstitial silver ions, the silver halide grain has many voids in a crystal, so that it also become necessary as a role of the ligand to satisfactorily fill in these voids.

These concepts can be realized by using the ligand satisfying the following conditions. In order to realize the good reciprocity law and latent image characteristics, it is preferred that the distance between a silver ion located in the position of (1/21/21) in coordinates in a silver halide crystal in which the central metal Ir is taken as an origin and the direction of an asymmetric ligand is taken as a C-axis and an atom interactable with a silver ion in the ligand is from 2.5 angstroms to 4.0 angstroms. More preferably, this distance is from 2.8 angstroms to 3.6 angstroms. In order to prevent the grain structure in the vicinity of the dopant proper from becoming unstable, it is necessary to use a bulky ligand as the ligand of the complex with which the silver halide grain is doped. The ligand contained in the complex is preferably a ligand having both the size and form in which not only a $Cl^-$ ion is replaced alone but also the $Cl^-$ ion and an $Ag^+$ ion adjacent thereto are replaced. The ligand is preferably a ligand which has a volume of 220% to 300% based on the volume of a chloride ion, and in which the distance from an atom in the ligand coordinated to the central metal of the metal complex to an atom in the ligand farthest away is 5.1 angstroms or less. More preferably, the ligand is a ligand which has a volume of 220% to 265% based on the volume of a chloride ion, and in which the distance from an atom in the ligand coordinated to the central metal of the metal complex to an atom in the ligand farthest away is 4.7 angstroms or less. When the molecular volume exceeds 300%, or when the atom farthest away from the ligand atom is more than 5.1 angstroms apart, the rate of introduction into the silver halide grain is unfavorably decreased.

The molecular volume can be calculated by various methods. In the present invention, the structure of a single molecule used in the ligand was optimized by molecular force field calculation using a Hyper Chem R6 software manufactured by Hypercube, Inc., and the molecular volume at that time was calculated by a method described in *J. Am. Chem. Soc.*, 105, 5220–5225 (1983). In the molecular force field calculation, parameters in the software were used as such. The structure of the molecule used in the ligand could also be optimized by quantum chemistry calculation such as MOPAC or ab initio. When the structure was optimized by PM3 or Gussian 94, calculation results are deviated several percent from those according to the present invention, depending on the calculation method and the basis function used. However, the preferred range in the present invention was not disturbed. In these calculations, the distance between the silver ion and the chloride ion was 2.7751 angstroms.

The ionic conductivity of the silver halide grain can be measured by a method described in *Nippon Shashin Gakkai-shi*, 44, 81–95 (1981). The ionic conductivity is well known to vary according to the amount of dopant and the kind of dopant, and there are some pieces of information on its relationship with photographic characteristics. However, the relationship between the desensitization or the decrease of contrast due to the illumination conversion dopant on the low intensity side and the ionic conductivity has not been made clear. In the present invention, it has been discovered that the dopant which does not bring about a large change from the ionic conductivity of an emulsion not doped, even when used in large amounts in the silver halide grain, particularly in the silver chloride grain, allows the desensitization or the decrease of contrast on the low intensity side to disappear (or minimizes them), which are adverse effects in using the illumination conversion dopant. That is to say, it has been discovered that the dopant is suitable for the object of the present invention, which gives the ionic conductivity at the time when the metal complex (dopant) is incorporated into the silver halide grain in an amount of $1\times10^{-4}$ mol per mol of silver is 50 times or less, preferably 30 times or less, that of the silver halide grain into which no metal ion or no metal complex is introduced. This is caused by that the use of the dopant of the present invention stabilizes the structure around the dopant to decrease the carrier mobility in measurement of the ionic conductivity. In the present invention, the measurement was made using a sample in which tetraazaindene was adsorbed by the 0.38-$\mu$m silver chloride cubic grain.

The ligand satisfying these conditions is preferably an organic compound having 3 or less carbon atoms or an inorganic compound. The term "inorganic compound" as used herein means a compound having no carbon-carbon bond, no carbon-hydrogen bond and no carbon-nitrogen-hydrogen bond. It is assumed that the space in the grain occupied by the ligand in the present invention is not spherical, but a rectangular parallelepiped. It is therefore unfavorable that the rectangular parallelepiped space of the ligand extends in the short axis. When the carbon-carbon bonds increase in a skeleton of the ligand, the carbon-hydrogen bonds are necessarily introduced to increase the bulk in the short axis of the rectangular parallelepiped, which unfavorably gives a further strain to the grain. Specific preferred examples of the ligands are compounds whose skeleton (i.e., basic structure) is thiadiazole, thiatriazole, oxadiazole or triazole. The substituent groups are preferably —F, —Cl, —Br, —OH, —SH, —CN, $—NO_2$, $—NH_2$, $—CH_3$, $—C_2H_5$, $—CH{=}CH_2$, $—CF_3$, $—CH_2OH$, $—CH_2Cl$, $—CNHNH_2$, —SCN, $—SO_2$, $—SO_3H$, $—OCH_3$, $—SCH_3$, $—SeCH_3$, $—NHCH_3$, $—N(CH_3)_2$, $—N(CN)_2$, $—NHSO_3H$, —COOH, $—COCH_3$, $—CONH_2$, $—CO_2NH_2$, $—CSCH_3$, $—OCOCH_3$, $—SOCH_3$, $—SCOCH_3$, $—SO_2CH_3$, $—SO_2CF_3$ and $—SO_2NH_2$, more preferably —F, —Cl, —Br, —OH, —SH, —CN, $—NO_2$, $—NH_2$, $—CH_3$, $—C_2H_5$, $—CH{=}CH_2$, $—CF_3$, $—CH_2OH$, $—CH_2Cl$, —SCN, $—SO_2$, $—SO_3H$, $—OCH_3$, $—SCH_3$, $—SeCH_3$, $—NHCH_3$, $—N(CN)_2$, —COOH, $—COCH_3$, $—CONH_2$, $—CSCH_3$, $—SOCH_3$, $—SO_2CF_3$ and $—SO_2NH_2$, and most preferably $—CH_3$, $—CF_3$, —F, —Cl and —Br. Either the same or different groups of these substituent groups may be used in one ligand. A compound represented by the following general formula (1) or (2) is also preferably used as the ligand.

$$X{=}Y(R_1)n \quad (1)$$

$$R_2{-}X{-}Y(R_1) \quad (2)$$

wherein X represents oxygen, sulfur, selenium or tellurium, Y represents carbon, nitrogen, sulfur or phosphorus, $R_1$ and $R_2$ each represents the above-mentioned substituent group, and n represents 1, 2 or 3.

$R_1$ is preferably —F, —Cl, —Br, —OH, —SH, —CN, $—NO_2$, $—NH_2$, $—CH_3$, $—C_2H_5$, $—CF_3$, $—CH_2OH$, $—CH_2Cl$, —SCN, $—SO_2$, $—SO_3H$, $—OCH_3$, $—SCH_3$, $—SeCH_3$, $—NHCH_3$ or —COOH, and more preferably —F, —Cl, —Br, —OH, —SH, —CN, $—NO_2$, $—NH_2$, $—CH_3$ or $—CF_3$. When n is 2 or 3, $R_1$'s may be the same or different. $R_2$ is preferably $—CH_3$, $—CF_3$, —OH, —SH, —CN, $—NO_2$ or $—NH_2$.

In the present invention, a complex of chromium, manganese, rhenium, iron, cobalt, nickel, copper, ruthenium, rhodium, palladium, osmium, iridium or platinum can be preferably used. However, more preferred is a complex of chromium, rhenium, iron, ruthenium, osmium, cobalt, rhodium or iridium, and most preferred is a complex of iridium. Although one to six ligands described above can be used in one complex molecule, one or two ligands are preferably used. As ligands other than the above-mentioned ligands, ones which play a role as anchors to the silver halide grains are preferred. specifically, preferred are $F^-$, $Cl^-$, $Br^-$, $CN^-$, $NO_2^-$, $OCN^-$, $SCN^-$, $N_3^-$, $OH^-$, $H_2O$, $NH_3$ and CO, and most preferred are $Cl^-$, $Br^-$, $CN^-$ and $SCN^-$.

Preferred examples of the complexes used in the present invention include but are not limited to the following complexes:

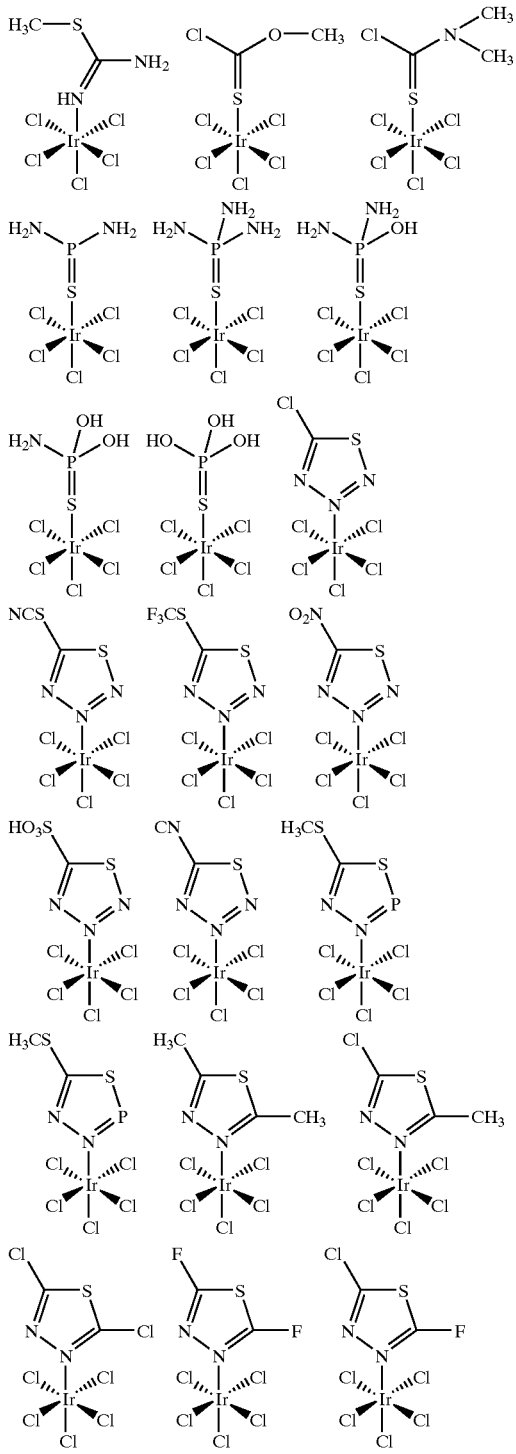

-continued

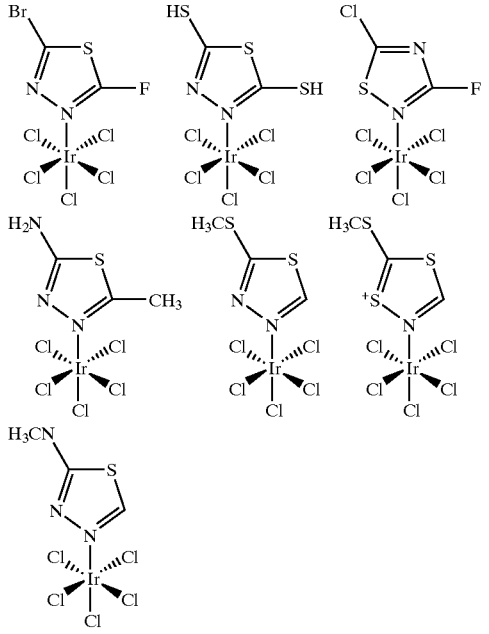

The illumination conversion time in the present invention can be determined by comparing a reciprocity law curve of an emulsion not doped to that of an emulsion in which the dopant for improving reciprocity failure is introduced into the silver halide grain. The reciprocity law curve can be drawn as shown in *Kaitei Shashin Kogaku no Kiso—Ginen Shashin—(Revised, the Fundamentals of Photographic Engineering—Silver Salt Photograph—)* edited by Nippon Shashin Gakkai, page 297. In the ordinary silver halide emulsion, particularly in the silver chloride emulsion, the sensitivity reaches the maximum around intermediate intensity, and desensitization occurs on the low intensity side and the high intensity side to draw a downwardly convex curve. In contrast with this, in a reciprocity law curve of an emulsion improved in the high intensity reciprocity failure by doping with the electron-releasing dopant, desensitization does not occur in a region on the side of higher intensities than a certain intensity to form a flat region. This differs from the reciprocity law curve of the emulsion not doped. The exposure time at the exposure illumination at which the curve starts to become flat, that is to say, at the exposure illumination at which the difference from the characteristic curve of the emulsion not doped occurs is taken as the illumination conversion time. The illumination conversion time is preferably 5 seconds. Considering the distribution of releasing time, the illumination conversion time is more preferably 1 second.

The electron-releasing time in the present invention can be measured by a double pulse photoconduction method. Using a microwave photoconduction method or a radio frequency wave photoconduction method, first short-time exposure is given, and then, second short-time exposure is given after an elapse of a certain definite time. Electrons are trapped in an electron trap in a silver halide crystal by the first exposure. When the second exposure is given immediately after that, the intensity of a second photoconduction signal is increased, because the electron trap is filled with the electrons. When the first exposure and the second exposure are given at a sufficient interval to already release the electrons trapped in the electron trap by the first exposure, the second photo conduction signal returns to approximately its original intensity. When changes in the intensity of the photoconduction signal at the second exposure are examined, changing the interval between the first exposure and the second exposure, a state can be measured in which the intensity of the photoconduction signal observed at the second exposure decreases with an increase in the exposure interval. This indicates the releasing time of the photoelectrons from the electron trap. The releasing of electrons continuously continues to occur for a certain definite time after the exposure in some cases. However, the releasing is observed preferably for a time from $10^{-5}$ second to 5 seconds, more preferably for a time from $10^{-4}$ second to 5 seconds, and still more preferably for a time from $10^{-3}$ second to 1 second.

In the present invention, the metal complex can be preferably incorporated into the inside and/or surface of the silver halide grain in the course of the formation and/or growth of the silver halide grain. When the complex is incorporated into the silver halide grain, it is preferred that the complex is allowed to homogeneously exist in the inside of the grain. However, it is also preferred that the complex is allowed to exist only in a surface layer of the grain, as disclosed in Japanese Patent Laid-Open Nos. 208936/1992, 125245/1990 and 188437/1991. Further, it is also preferred that the complex is allowed to exist only in the inside of the grain and a layer containing no complex is added to the surface of the grain. It is more preferred that the complex is incorporated into a portion outer than 50% from the center of the grain by the grain volume and the incorporation of the complex is discontinued at 98% from the center of the grain so as not to expose the complex to the grain surface. Particularly preferably, the complex is incorporated into a layer between 80% and 98% from the center of the grain by the grain volume. It is also preferred that physical ripening is conducted with fine grains into which the complex is incorporated to improve a surface phase of the grain, as disclosed in U.S. Pat. Nos. 5,252,451 and 5,256,530. Further, these methods can be used in combination, and plural kinds of complexes may be incorporated into one silver halide grain. There is no particular limitation on the halogen composition in a position in which the complex is contained, and the complex may be contained in any one of silver chloride, silver chlorobromide, silver bromide, silver iodo chloride and silver iodobromide. It is particularly preferred that the complex is contained in a silver chlorobromide layer.

In the present invention, the above-mentioned complex can be used preferably in an amount of $1\times10^{-10}$ mol to $1\times10^{-4}$ mol per mol of silver, more preferably in an amount of $1\times10^{-9}$ mol to $1\times10^{-5}$ mol per mol of silver. The complex is preferably incorporated into the silver halide grain by directly adding the complex to a reaction solution in forming the silver halide grain, or adding the complex to an aqueous solution of a halide for forming the silver halide grain or a solution other than that, thereby adding the complex to a grain forming reaction solution. It is also preferred that these methods are combined to allow the complex to be contained in the silver halide grain. When the central metal is an iridium ion, either the III-valent ion or the IV-valent ion may be used. However, the III-valent ion is preferably used. The iridium III-valent complex having a bromide ion as the ligand is easily oxidized, so that an oxidizing agent is preferably added to a solution to be added to an emulsion. The oxidizing agent added is a reductone, a hydrazine, a hydroxylamine compound, a hydroxysemicarbazide compound, a hydroxyurethane compound, a hydroxyurea compound, a hydroxamic acid, a compound having a skeleton analogous to that of vitamin E, a phenylenediamine compound, a phenidone, a hydrazide or a phenol. Most preferred is a reductone.

The silver halide grain in the silver halide emulsion used in the present invention is preferably a cubic or tetradecahedral crystal grain substantially having the {100} face (the grain may be rounded at its apexes and may have a hkl plane) or an octahedral crystal grain, or a tabular grain having an aspect ratio of 2 or more in which 50% or more of the whole projected area is composed of the {100} face or the {111} face. The aspect ratio is a value obtained by dividing the diameter of a circle corresponding to a projected area by the thickness of the grain. In the present invention, there is preferably applied the cubic grain, the tabular grain having the {100} face as the main face, or the tabular grain having {111} face as the main face.

Although the silver halide emulsions used in the present invention include silver chloride, silver bromide, silver iodobromide and silver chloro(iodo)bromide emulsions, an emulsion containing specific silver halide grains composed of silver iodobromochloride is preferred. In the preferred silver iodobromochloride emulsion described above, the silver chloride content is required to be from 89 mol % to 99.7 mol %. From the viewpoint of rapid processability, the silver chloride content is preferably from 93 mol % to 99.5 mol %, and more preferably from 95 mol % to 98.5 mol %. The silver bromide content is required to be from 0.25 mol % to 10 mol %. In order to obtain high contrast and low fog density, the silver bromide content is preferably from 0.5 mol % to 6 mol %, and more preferably from 1 mol % to 4 mol %. The silver iodide content is required to be from 0.05 mol % to 1 mol %. In terms of high sensitivity and high contrast in the high intensity exposure, the silver iodide content is preferably from 0.05 mol % to 0.6 mol %, and more preferably from 0.1 mol % to 0.4 mol %.

The silver halide grain used in the silver halide emulsion of the present invention has a silver bromide-containing layer and/or a silver iodide-containing layer (this grain is also hereinafter referred to as a specific silver halide grain). The term "silver bromide- or silver iodide-containing layer" as used herein indicates a portion having a silver bromide or silver iodide content higher than that per one grain, and means a site high in the concentration of silver bromide or silver iodide. The halogen composition of the silver bromide or silver iodide layer and its surroundings may be changed either continuously or abruptly. Such a silver bromide or silver iodide layer may form a layer having an approximately constant concentration width in a certain portion in the grain, or may be a maximum point having no spread. The local silver bromide content of the silver bromide-containing layer is preferably 5 mol % or more, more preferably from 10 mol % to 80 mol %, and most preferably from 15 mol % to 50 mol %. The local silver iodide content of the silver iodide-containing layer is preferably 0.2 mol % or more, more preferably from 0.5 mol % to 8 mol %, and most preferably from 1 mol % to 5 mol %. Such silver bromide- or silver iodide-containing layers may be present as plural layers in the grain, and each layer may have a different silver bromide or silver iodide content. However, it is necessary to have at least one silver bromide- or silver iodide-containing layer.

The silver bromide- or silver iodide-containing layer of the silver halide emulsion of the present invention can be disposed in the layer form so as to surround the grain. It is one preferred embodiment that the silver bromide- or silver iodide-containing layer disposed in the layer form so as to surround the grain has a uniform concentration distribution in the circumferential direction of the grain in each layer. However, in the silver bromide- or silver iodide-containing layer disposed in the layer form so as to surround the grain, the maximum point or the minimum point of the silver bromide or silver iodide concentration may be present in the circumferential direction of the grain to have a concentration distribution. For example, when the silver bromide- or silver iodide-containing layer is disposed in the layer form in the vicinity of a surface of the grain so as to surround the grain, the silver bromide or silver iodide concentration of corners or edges of the grain is different from that in the main surface in some cases. Further, the silver bromide- or silver iodide-containing layer may be present in isolation on specific portions (such as corners or edges) of the rain so as not to surround the grain.

The silver bromide-containing layer of the silver halide emulsion of the present invention can be formed in the layer form so as to have the silver bromide concentration maximum in the inside of the grain, or a portion having the silver bromide concentration maximum may be formed in isolation in the inside of the grain. Further, the portions having the silver bromide concentration maximum may be present as plural layers in one grain. It is preferred that the silver iodide-containing layer of the silver halide emulsion of the present invention is formed in the layer form. The amount of silver constituting such a silver bromide- or silver iodide-containing layer is preferably from 3% to 30% of the grain volume, and more preferably from 3% to 15% of the grain volume, in that less silver bromide or silver iodide content is required for increased local concentration.

The silver halide emulsion of the present invention is required to contain both the silver bromide-containing layer and the silver iodide-containing layer. The silver bromide-containing layer may contain silver iodide, and conversely, the silver iodide-containing layer may contain silver bromide. The silver bromide-containing layer is required to be disposed inside the silver iodide-containing layer. The silver bromide-containing layer is interpreted as being inside the silver iodide-containing layer, as long as the silver bromide-containing layer is partly disposed inside the silver iodide-containing layer. For example, when the silver bromide-containing layer is continuously present from a certain portion in the inside of the grain to the surface thereof, it is sufficient that the silver iodide-containing layer is outside the starting portion of the silver bromide-containing layer. Important is that the starting portion of the silver bromide-containing layer is present inside the starting portion of the silver iodide-containing layer. For enhancing the effects of the present invention, it is preferred that the silver bromide-containing layer is present inside the silver iodide-containing layer, adjacent thereto. The silver bromide concentration maximum may be present outside the silver iodide concentration maximum. However, for attaining the effects of the present invention, it is preferred that the silver bromide concentration maximum is present inside the silver iodide concentration maximum. Another silver bromide-containing layer may be provided further outside the silver iodide-containing layer on the surface side of the grain, and another silver iodide-containing layer may be provided further inside the silver bromide-containing layer.

The content of silver bromide or silver iodide necessary for manifesting the effects of the present invention such as increase of sensitivity and increase of contrast increases with the formation of the silver bromide- or silver iodide-containing layer in the inside of the grain to decrease the silver chloride content more than necessary, resulting in the possibility of impairing the rapid processability. Accordingly, in order to collect near the surface in the grain these functions controlling photographic functions, it is preferred that the silver bromide-containing layer is adjacent to the silver iodide-containing layer. From these points, the silver bromide-containing layer is preferably formed at any position of 50% to 100% of the grain volume measure from the inside, and the silver iodide-containing layer is preferably formed at any position of 85% to 100% of the grain volume. More preferably, the silver bromide-containing layer is formed at any position of 70% to 95% of the grain volume measure from the inside, and the silver iodide-containing layer is formed at any position of 90% to 100% of the grain volume.

As for the introduction of a bromide ion or an iodide ion for adding silver bromide or silver iodide to the silver halide emulsion of the present invention, a bromide or iodide solution may be added independently, or a bromide or iodide solution may be added together with a silver salt solution and a high chloride solution. In the latter case, the bromide or iodide solution and the high chloride solution may be added either separately or as a mixed solution of the bromide or the iodide and the high chloride. The bromide or the iodide is added in the form of a soluble salt such as an alkali or alkali earth metal bromide or iodide. Alternatively, the bromide or the iodide can also be introduced as a bromide ion or an iodide ion cleaved from an organic molecule described in U.S. Pat. No. 5,389,508. As another bromide or iodide ion source, there can also be used fine silver bromide grains or fine silver iodide grains.

The bromide or iodide solution may be added either collectively at one time in the course of grain formation or for a definite period of time. The position of a high chloride emulsion into which the iodide ion is introduced is limited for obtaining a high sensitive and low fogging emulsion. The more inside the iodide ion is introduced into the emulsion grain, the less the sensitivity is increased. Accordingly, the iodide solution is added preferably outside 50% of the grain volume, more preferably outside 70% of the grain volume, and most preferably outside 85% of the grain volume. Further, the iodide solution is added preferably inside 98% of the grain volume, and most preferably inside 96% of the grain volume. A higher sensitive and lower fogging emulsion can be obtained by terminating the addition of the iodide solution slightly inside the grain surface. On the other hand, the bromide solution is added preferably outside the 50% of the grain volume, and more preferably outside the 70% of the grain volume.

The distribution of the bromide or iodide ion concentration in the depth direction in the grain can be measured by the etching/TOF-SIMS (time of flight-secondary ion mass spectrometry) method, for example, using a TRIFT II type TOF-SIMS manufactured by Phi Evans. The TOF-SIMS method is specifically described in "Surface Analytical Technology Series, Secondary Ion Mass Spectrometry" edited by Nippon Hyomen Kagaku-kai, Maruzen Co., Ltd. (1999). The analysis of the emulsion grain by the etching/TOF-SIMS method makes it possible to analyze the ooze of the iodide ion toward the grain surface even when the addition of the iodide solution is terminated inside the grain. In the emulsion of the present invention, the iodide ion preferably has the concentration maximum in the grain surface to decrease the iodide ion concentration toward the inside of the grain, and the bromide ion preferably has the center of distribution more inside than the iodide ion and further the concentration maximum in the inside of the grain, by the analysis according to the etching/TOF-SIMS method.

The local concentration of silver bromide can also be measured by the X-ray diffraction method, as long as the silver bromide content is high to some extent.

In this specification, the equivalent sphere diameter is indicated by the diameter of a sphere having the same volume as each grain. The emulsion of the present invention is required to form the grain structure very precisely, so that it is preferred that the emulsion is composed of grains which are monodisperse in a grain size distribution. The coefficient of variation of the equivalent sphere diameters of all grains of the present invention is preferably 20% or less, more preferably 15% or less, and most preferably 10% or less. The coefficient of variation of the equivalent sphere diameters is indicated by the percentage of the standard deviation of the equivalent sphere diameters of the respective grains to the mean of the equivalent sphere diameters. In this case, in order to obtain a wide latitude, the above-mentioned monodisperse emulsion is also preferably blended in the same layer or applied in multiple layers.

The equivalent sphere diameter of the silver halide grain contained in the silver halide emulsion of the present invention is 0.6 $\mu$m or less, more preferably 0.5 $\mu$m or less, and most preferably 0.4 $\mu$m or less. The grain having a equivalent sphere diameter of 0.6 $\mu$m corresponds to a cubic grain having a side length of about 0.48 $\mu$m, the grain having a equivalent sphere diameter of 0.5 $\mu$m corresponds to a cubic grain having a side length of about 0.4 $\mu$m, and the grain having a equivalent sphere diameter of 0.4 $\mu$m corresponds to a cubic grain having a side length of about 0.32 $\mu$m. The silver halide emulsion of the present invention may contain silver halide grains other than the silver halide grains contained in the silver halide emulsion defined in the present invention (that is to say, the specific silver halide grains). However, in the silver halide emulsion defined in the present invention, 50% or more of the total projected area of all grains is required to be the silver halide grains defined in the present invention. The silver halide grains defined in the present invention occupy preferably 80% or more, and more preferably 90% or more, of the total projected area of all grains.

The metal complex of the present invention can be used together with a different iridium complex having a short releasing time, thereby more enhancing the effect of improving the reciprocity failure. A preferred example of the different iridium complex used together with the metal complex of the present invention is an Ir complex having at least one ligand other than halogen, and preferably a six-coordinated complex. The ligand other than halogen is preferably a cyanide ion, water, a hydroxide ion, $O^{2-}$ or OCN, and more preferably a six-coordinated complex having Ir as a central metal, which has at least one water, a hydroxide ion, $O^{2-}$ or OCN as a ligand, and whose remaining ligand is Cl, Br or I. Specific examples of the six-coordinated complexes each having Ir as a central metal, which has at least one $H_2O$, OH, $O^{2-}$ or OCN as a ligand, and whose remaining ligand is Cl, Br or I, include but are not limited to the following complexes:

$[IrCl_5(H_2O)]^{2-}$
$[IrCl_4(H_2O)_2]^{-}$
$[IrBr_5(H_2O)]^{2-}$
$[IrBr_4(H_2O)_2]^{-}$
$[IrCl_5(OH)]^{3-}$
$[IrCl_4(OH)_2]^{3-}$
$[IrBr_5(OH)]^{3-}$
$[IrBr_4(OH)_2]^{3-}$
$[IrCl_5(O)]^{4-}$
$[IrCl_4(O)_2]^{5-}$
$[IrBr_5(O)]^{4-}$
$[IrBr_4(O)_2]^{5-}$
$[IrCl_5(OCN)]^{3-}$
$[IrBr_5(OCN)]^{3-}$

When the complex is incorporated into the silver halide grain, it can be allowed to uniformly exist in the grain. However, it is also preferred that the complex is allowed to exist only in a surface layer of the grain as disclosed in Japanese Patent Laid-Open Nos. 208936/1992, 125245/1990 and 188437/1991. It is also preferred that the complex is allowed to exist only in the inside of the grain and a layer containing no complex is added to the surface of the grain. Further, it is also preferred that a fine grain into which the complex is incorporated is physically ripened to modify a surface phase of the grain. Further, these methods can be used in combination, and plural kinds of complexes may be incorporated into one silver halide grain. There is no particular limitation on the halogen composition in a position in which the complex is contained, and the complex is preferably contained either in a pure silver chloride layer or in a silver chlorobromide layer. These complexes are added preferably in an amount of $1\times10^{-9}$ mol to $1\times10^{-3}$ mol per mol of silver, and most preferably in an amount of $1\times10^{-7}$ mol to $1\times10^{-5}$ mol per mol of silver, during grain formation.

In the present invention, the inside and/or surface of the silver halide grain may be doped with another metal ion other than iridium described above. The metal ion used is preferably iron, ruthenium, osmium, lead, cadmium or zinc. Further, these metal ions are preferably used as six-coordinated octahedral complexes having ligands. When an inorganic compound is used as the ligand, there is preferably used a cyanide ion, a halide ion, thiocyanogen, a hydroxide ion, a peroxide ion, an azide ion, a nitrite ion, water, ammonia, a nitrosyl ion or a thionitrosyl ion, which is also preferably coordinated to any metal ion of iron, ruthenium, osmium, lead, cadmium and zinc described above. It is also preferred that plural kinds of ligands are used in one complex molecule. Further, as the ligand, an organic compound can also be used preferred examples of the organic compounds include a chain compound whose main chain has 5 or less carbon atoms and/or a 5-membered or 6-membered heterocyclic compound. The organic compound is more preferably a compound having a nitrogen atom, a phosphorus atom, an oxygen atom or a sulfur atom in its molecule as a coordination atom to a metal, and particularly preferably furan, thiophene, oxazole, isooxazole, thiazole, isothiazole, imidazole, pyrazole, triazole, furazan, pyran, pyridine, pyridazine, pyrimidine or pyrazine. Further, compounds obtained by using these compounds as basic skeletons and further introducing substituent groups into them are also preferred.

The combination of the metal ion and the ligand is preferably a combination of an iron ion or a ruthenium ion and a cyanide ion. The iridium complex in the present invention is also preferably used together with these compounds. In these compounds, it is preferred that the cyanide ion occupies the majority of the coordination number to iron or ruthenium, the central metal, and that thiocyanogen, ammonia, water a nitrosyl ion, dimethyl sulfoxide, pyridine, pyrazine or 4,4'-bipyridine occupies the remaining coordination sites. Most preferably, six coordination sites of the central metal are all occupied with the cyanide ions to form a hexacyanoiron complex or a hexacyanoruthenium complex. These complexes having the cyanide ions as the ligands are added preferably in an amount of $1\times10^{-8}$ mol to $1\times10^{-2}$ mol per mol of silver, and most preferably in an amount of $1\times10^{-6}$ mol to $5\times10^{-4}$ mol per mol of silver, during grain formation. When ruthenium and osmium are used as the central metals, a nitrosyl ion, a thionitrosyl ion, or a water molecule and a chloride ion are also preferably used together as the ligands. The formation of a pentachloronitrosyl complex, a pentachlorothionitrosyl complex or a pentachloroaqua complex is more preferred, and the formation of a hexachloro complex is also preferred. These complexes are added preferably in an amount of $1\times10^{-10}$ mol to $1\times10^{-6}$ mol per mol of silver, and more preferably in an amount of $1\times10^{-9}$ mol to $5\times10^{-6}$ mol per mol of silver, during grain formation.

The silver halide emulsion of the present invention is usually subjected to chemical sensitization. As for the chemical sensitization, sulfur sensitization represented by addition of an labile sulfur compound, noble metal sensitization represented by gold sensitization and reduction sensitization can be used either alone or in combination. As compounds used in the chemical sensitization, there are preferably used compounds described in Japanese Patent Laid-Open No. 215272/1987, page 18, lower right column to page 22, upper right column. Of these, the gold sensitization is particularly preferred, because the application of the gold sensitization can further decrease fluctuation in photographic properties in scanning exposure with laser beams and so on.

Various inorganic gold compounds, inorganic ligand-containing gold (I) complexes and organic ligand-containing gold (I) compounds can be utilized for the application of the gold sensitization to the silver halide emulsion of the present invention. As the inorganic gold compounds, there can be used, for example, chloroauric acid and a salt thereof. As the inorganic ligand-containing gold (I) complexes, there can be used, for example, gold dithiocyanate compounds such as potassium gold (I) dithiocyanate and gold dithiosulfate compounds such as trisodium gold (I) dithiosulfate.

The silver halide emulsion of the present invention is preferably gold sensitized with colloidal gold sulfide or a gold sensitizer having a gold complex stability constant (log $\beta_2$) of 21 to 35. Methods for producing colloidal gold sulfide are described in *Research Disclosure*, 37154, *Solid State Ionics*, 79, 60–66 (1995) and *Compt. Rend. Hebt. Seances Acad. Sci. Sect., B*263, 1328 (1966). Colloidal gold sulfide having various sizes can be utilized, and one having a size of 50 nm or less can also be used. Although the amount thereof added is widely changeable according to circumstances, it is from $5\times10^{-7}$ mol to $5\times10^{-3}$ mol, and preferably from $5\times10^{-6}$ mol to $5\times10^{-4}$ mol, in terms of gold, per mol of silver halide. In the present invention, the gold sensitization may be further combined with another sensitization such as sulfur sensitization, selenium sensitization, tellurium sensitization, reduction sensitization or noble metal sensitization using a compound other than gold.

The gold sensitizer having a gold complex stability constant (log $\beta_2$) of 21 to 35 will be described below.

The gold complex stability constant (log $\beta_2$) is determined by calculation from a gold potential value measured by applying measuring methods descried in *Conmprehensive Coordination Chemistry*, chapter 55, page 864 (1987), *Encyclopedia of Electrochemistry of the Elements*, chapter IV-3 (1975), *Journal of the Royal Netherlands Chemical Society*, 101, 164 (1982) and references thereof, under the conditions that the measuring temperature is 25° C., the pH is adjusted to 6.0 with a potassium dihydrogenphosphate/disodium hydrogenphosphate buffer solution, and the ionic strength is 0.1 M (KBr). The log $\beta_2$ value of the thiocyanate ion obtained by this measuring method is 20.5, which approximates to a value described in the literature (*Comprehensive Coordination Chemistry*, chapter 55, page 864, table 2 (1987), 20.

In the present invention, the gold sensitizer having a gold complex stability constant (log $\beta_2$) of 21 to 35 is preferably represented by the following general formula (I):

$$\{(L^1)_x(Au)_y(L^2)_z.Q_q\}_p \quad \text{(I)}$$

In general formula (I), $L^1$ and $L^2$ each independently represents a compound whose log $\beta_2$ value is contained between 21 and 35, preferably between 22 and 31, and more preferably between 24 and 28.

$L^1$ and $L^2$, which may be the same or different, each represents, for example, a compound containing at least one labile sulfur group which can react with a silver halide to form silver sulfide, a hydantoin compound, a thioether compound, a mesoionic compound, —SR', a heterocyclic compound, a phosphine compound, an amino acid derivative, a saccharide derivative or a thiocyano group, wherein R' represents an aliphatic hydrocarbon group, an aryl group, a heterocyclic group, an acyl group, a carbamoyl group, a thiocarbamoyl group or a sulfonyl group.

Q represents a counter anion or counter action necessary for neutralizing the charge of the compound, x and z each represents an integer of from 0 to 4, y and p each represents 1 or 2, and q represents a value of from 0 to 1 including a decimal, provided both x and z are not 0.

As a preferred example of the compound represented by general formula (I), $L^1$ and $L^2$ each represents a compound containing at least one labile sulfur group which can react with a silver halide to form silver sulfide, a hydantoin compound, a thioether compound, a mesoionic compound, —SR', a heterocyclic compound or a phosphine compound, and x, y and z each represents 1.

As a more preferred example of the compound represented by general formula (I), $L^1$ and $L^2$ each represents a compound containing at least one labile sulfur group which can react with a silver halide to form silver sulfide, a masoionic compound or —SR', and x, y, z and p each represents 1.

The gold compounds represented by general formula (I) will be described in more detail below.

The compound containing at least one labile sulfur group which can react with a silver halide to form silver sulfide, which is represented by each of $L^1$ and $L^2$, is a thioketone (for example, a thiourea compound, a thiamide compound or a rhodanine compound), a thiophosphate or a thiosulfuric acid compound.

The compound containing at least one labile sulfur group which can react with a silver halide to form silver sulfide is preferably a thioketone (for example, a thiourea compound or a thioamide compound) or a thiosulfuric acid compound.

Then, the hydantoin compounds represented by $L^1$ and $L^2$ in general formula (I) include, for example, unsubstituted hydantoin and N-methylhydantoin, and the thioether compounds include a chain or cyclic thioether having 1 to 8 thio groups, which are connected by a substituted or unsubstituted straight chain or branched alkylene group (for example, ethylene or triethylene) or a phenylene group, such as bishydroxyethyl thioether, 3,6-dithia-1,8-octanediol or 1,4,8,11-tetrathiacyclotetradecane. The mesoionic compounds include a mesoionic-3-mercapto-1,2,4-triazole compound (for example, mesoionic-1,4,5-trimethyl-3-mercapto-1,2,4-triazole).

Then, when $L^1$ and $L^2$ each represents —SR' in general formula (I), the aliphatic hydrocarbon groups represented by R' include a substituted or unsubstituted straight chain or branched alkyl group having from 1 to 30 carbon atoms (for example, methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodiumsulfoethyl, diethylaminoethyl, diethylaminopropyl, butoxypropyl, ethoxyethoxyethyl or n-hexyloxypropyl), a substituted or unsubstituted cyclic alkyl group having from 3 to 18 carbon atoms (for example, cyclopropyl, cyclopentyl, cyclohexyl, cyclooctyl, adamantyl or cyclododecyl), an alkenyl group having from 2 to 16 carbon atoms (for example, allyl, 2-butenyl or 3-pentenyl), an alkynyl group having from 2 to 10 carbon atoms (for example, propargyl or 3-pentynyl) and an aralkyl group having from 6 to 16 carbon atoms (for example, benzyl). The aryl groups include a substituted or unsubstituted phenyl group having from 6 to 20 carbon atoms and a naphthyl group (for example, unsubstituted phenyl, unsubstituted naphthyl, 3,5-dimethylphenyl, 4-butoxyphenyl, 4-dimethylaminophenyl or 2-carboxyphenyl), and the heterocyclic groups include, for example, a substituted or unsubstituted nitrogen-containing 5-membered heterocyclic group (for example, imidazolyl, 1,2,4-triazolyl, tetrazolyl, oxadiazolyl, thiadiazolyl, benzoimidazolyl or purinyl), a substituted or unsubstituted nitrogen-containing 6-membered heterocyclic group (for example, pyridyl, piperidyl, 1,3,5-triazino, 4,6-dimercapto-1,3,5-triazino), a furyl group or a thienyl group. The acyl groups include, for example, acetyl and benzoyl, and the carbamoyl groups include, for example, dimethylcarbamoyl. The thiocarbamoyl groups include, for example, diethylthiocarbamoyl, and the sulfonyl groups include a substituted or unsubstituted alkylsulfonyl group having from 1 to 10 carbon atoms (for example, methanesulfonyl or ethanesulfonyl) and a substituted or unsubstituted phenylsulfonyl group having from 6 to 16 carbon atoms (for example, phenylsulfonyl).

Further, in —SR' represented by $L^1$ and $L^2$, R' is preferably an aryl group or a heterocyclic group, more preferably a heterocyclic group, more preferably a 5-membered or 6-membered nitrogen-containing heterocyclic group, and most preferably a nitrogen-containing heterocyclic group substituted by a water-soluble group (for example, sulfo, carboxyl, hydroxyl or amino).

The heterocyclic compounds represented by $L^1$ and $L^2$ in general formula (I) include a substituted or unsubstituted nitrogen-containing 5-membered heterocyclic compound (for example, a pyrrole compound, an imidazole compound, a pyrazole compound, a 1,2,3-triazole compound, a 1,2,4-triazole compound, a tetrazole compound, an oxazole compound, an isooxazole compound, an isothiazole compound, an oxadiazole compound, a thiadiazole compound, a pyrrolidine compound, a pyrroline compound, an imidazolidine compound, an imidazoline compound, a pyrazolidine compound, a pyrazoline compound or a hydantoin compound) and a heterocyclic compound containing the above-mentioned 5-membered ring (for example, an indole compound, an isoindole compound, an indolizine compound, an indazole compound, a benzimidazole compound, a purine compound, a benzotriazole compound, a carbazole compound, a tetraazaindene compound, a benzothiazle compound or an indoline compound), a substituted or unsubstituted nitrogen-containing 6-membered heterocyclic compound (for example, a pyridine compound, a pyrazine compound, a pyrimidine compound, a pyridazine compound, a triazine compound, a thiadiazine compound, a piperidine compound, a piperazine compound or a morpholine compound) and a heterocyclic compound containing the above-mentioned 6-membered ring (for example, a quinoline compound, an isoquinoline compound, a phthalazine compound, a naphthyridine compound, a quinoxaline compound, a quinazoline compound, a pteridine compound, a phenathyridine compound, an acridine compound, a phenanthroline compound or a phenazine compound), a substituted or unsubstituted furan compound, a substituted or unsubstituted thiophene compound and a benzothiazolium compound.

The heterocyclic compounds represented by $L^1$ and $L^2$ are preferably unsaturated nitrogen-containing 5-membered or 6-membered heterocyclic compounds or heterocyclic compounds containing them, and examples thereof include a pyrrole compound, an imidazole compound, a pyrazole compound, a 1,2,4-triazole compound, an oxadiazole compound, a thiadiazole compound, an imidazoline compound, an indole compound, an indolizine compound, an indazole compound, a benzimidazole compound, a purine compound, a benzotriazole compound, a carbazole compound, a tetraazaindene compound, a benzothiazle compound, a pyridine compound, a pyrazine compound, a pyrimidine compound, a pyridazine compound, a triazine compound, a quinoline compound, an isoquinoline compound and a phthalazine compound. Further, preferred is a heterocyclic compound known in the art as an antifoggant (for example, an indazole compound, a benzimidazole compound or a tetraazaindene compound).

The phosphine compounds represented by $L^1$ and $L^2$in general formula (I) are phosphine compounds each substituted by an aliphatic hydrocarbon group having from 1 to 30 carbon atoms, an aryl group having from 6 to 20 carbon atoms, a heterocyclic group (for example, pyridyl), a substituted or unsubstituted amino group (for example, dimethylamino) and/or an alkyloxy group (for example, methyloxy or ethyloxy). Preferred examples thereof include a phosphine compound substituted by an alkyl group having from 1 to 10 carbon atoms or an aryl group having from 6 to 12 carbon atoms (for example, triphenylphosphine or triethylphosphine).

Further, the above-mentioned mesoionic compounds, —SR' and heterocyclic compounds represented by $L^1$ and $L^2$ are preferably substituted by labile sulfur groups each of which can react with a silver halide to form silver sulfide (for example, thioureido).

Furthermore, the compounds represented by $L^1$ and $L^2$ in the above-mentioned general formula (I) may further have substituent groups wherever possible. The substituent groups include, for example, a halogen atom (for example, fluorine, chlorine or bromine), an aliphatic hydrocarbon group (for example, methyl, ethyl, isopropyl, n-propyl, t-butyl, n-octyl, cyclopentyl or cyclohexyl), an alkenyl group (for example, allyl, 2-butenyl or 3-pentenyl), an alkynyl group (for example, propargyl or 3-pentynyl), an aralkyl group (for example, benzyl or phenetyl), an aryl group (for example, phenyl, naphthyl or 4-methylphenyl), a heterocyclic group (for example, pyridyl, furyl, imidazolyl, piperidinyl or morpholyl), an alkyloxy group (for example, methoxy, ethoxy, butoxy, 2-ethylhexyloxy, ethoxyethoxy or methoxyethoxy), an aryloxy group (for example, phenoxy or 2-naphthyloxy), an amino group (for example, unsubstituted amino, dimethylamino, diethylamino, dipropylamino, dibutylamoino, ethylamino, dibenzylamino or anilino), an acylamino group (for example, acetylamino or benzoylamino), a ureido group (for example, unsubstituted ureido, N-methylureido or N-phenylureido), a thioureido group (for example, unsubstituted thioureido, N-methylthioureido or N-phenylthioureido), a selenoureido group (for example, unsubstituted selenoureido), a phosphineselenide group (for example, diphenylphosphineselenide), a telluroureido group (for example, unsubstituted telluroureido), a urethane group (for example, methoxycarbonylamino or phenoxycarbonylamino), a sulfonamido group (for example, methylsulfonamido or phenylsulfonamido), a sulfamoyl group (for example, unsubstituted sulfamoyl, N,N-dimethylsulfamoyl or N-phenylsulfamoyl), a carbamoyl group (for example, unsubstituted carbamoyl, N,N-diethylcarbamoyl or N-phenylcarbamoyl), a sulfonyl group (for example, methanesulfonyl or p-toluenesulfonyl), a sulfinyl group (for example, methylsulfinyl or phenylsulfinyl), an alkyloxycarbonyl group (for example, methoxycarbonyl or ethoxycarbonyl), an aryloxycarbonyl group (for example, phenoxycarbonyl), an acyl group (for example, acetyl, benzoyl, formyl or pivaloyl), an acyloxy group (for example, acetoxy or benzoyloxy), a phosphoric acid amide group (for example, N,N-diethylphosphoric acid amide), an alkylthio group (for example, methylthio or ethylthio), an arylthio group (for example, phenylthio), a cyano group, a sulfo group, a thiosulfonic acid group, a sulfinic acid group, a carboxy group, a hydroxy group, a mercapto group, a phosphono group, a nitro group, a sulfino group, an ammonio group (for example, trimethylammonio), a phosphonio group, a hydrazino group, a thiazolino group and a silyloxy group (for example, t-butyldimethylsilyloxy or t-butyldiphenylsilyloxy). When there are two or more substituent groups, they may be the same or different.

Then, Q and q in general formula (I) will be described.

In general formula (I), the counter anions represented by Q include a halogenium ion (for example, $F^-$, $Cl^-$, $Br^-$ or $I^-$), a tetrafluoroborate ion ($BF_4^-$), a hexafluorophosphate ion ($PF_6^-$), a sulfate ion ($SO_4^{2-}$), an arylsulfonate ion (for example, a p-toluenesulfonate ion or a naphthalene-2,5-disulfonate ion) and a carboxyl ion (for example, an acetate ion, a trifluoroacetate ion, an oxalate ion or a benzoate ion). The counter cations represented by Q include an alkali metal ion (for example, a lithium ion, a sodium ion, a potassium ion, a rubidium ion or a cesium ion), an alkali earth metal ion (for example, a magnesium ion or a calcium ion), a substituted or unsubstituted ammonium ion (for example, an unsubstituted ammonium ion, a triethylammonium ion or a tetramethylammonium ion), a substituted or unsubstituted pyridinium ion (for example, an unsubstituted pyridinium ion or 4-phenylpyridinium ion) and further a proton. q is the number of Q for neutralizing the charge of the compound, and represents a value of from 0 to 1, which may be a decimal.

The counter anion represented by Q is preferably a halogenium ion (for example, $Cl^-$ or $Br^-$), a tetrafluoroborate ion, a hexafluorophosphate ion or a sulfate ion, and the counter cation represented by Q is preferably an alkali metal ion (for example, a sodium ion, a potassium ion, a rubidium ion or a cesium ion), a substituted or unsubstituted ammonium ion (for example, an unsubstituted ammonium ion, a triethylammonium ion or a tetramethylammonium ion) or a proton.

Specific examples (L-1 to L-17) of the compounds represented by $L^1$ and $L^2$ are shown below, but the scope of the present invention is not limited thereto. The values in parentheses indicate log $\beta_2$ values.

(L-1)

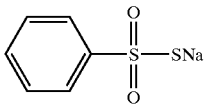

(22)

-continued (L-2)

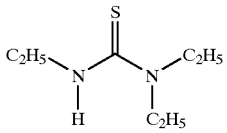

(24)

(L-3)

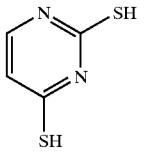

(25)

(L-4)

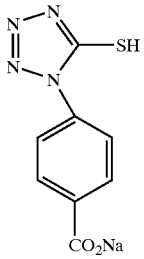

(25)

(L-5)

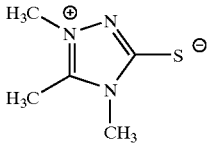

(26)

(L-6)

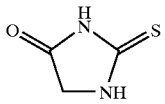

(27)

(L-7)

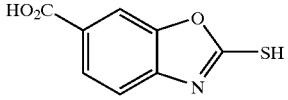

(27)

(L-8)

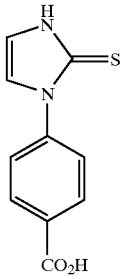

(27)

(L-9)

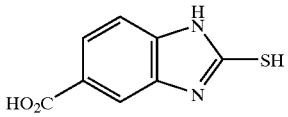

(27)

(L-10)

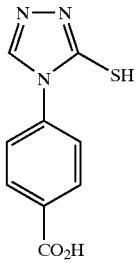

(27)

-continued (L-11)

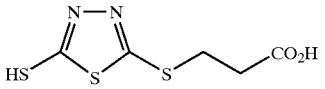

(27)

(L-12)

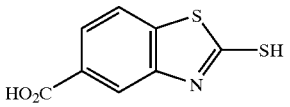

(27)

(L-13)

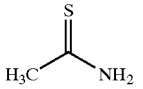

(28)

(L-14)

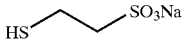

(28)

(L-15)

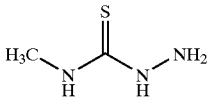

(29)

(L-16)

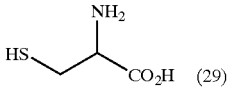

(29)

(L-17)

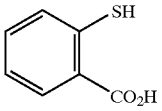

(30)

The compounds represented by general formula (I) can be synthesized using known methods, for example, methods described in *Inorg. Nucl. Chem. Letters*, 10, 641 (1974), *Transition Met. Chem.*, 1, 248 (1976), *Acta. Cryst., B*32, 3321 (1976), Japanese Patent Laid-Open No. 69075/1996, Japanese Patent Publication No. 8831/1970, EP-A-915371, Japanese Patent Laid-Open Nos. 11788/1994, 501789/1994, 267249/1992 and 118685/1997, as reference.

Specific examples (S-1 to S-19) of the compounds represented by $L^1$ and $L^2$ are shown below, but the scope of the present invention is not limited thereto.

(S-1)

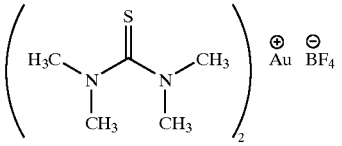

(S-2)

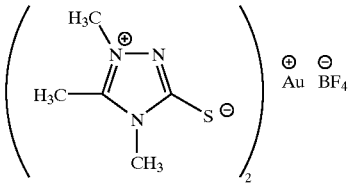

-continued (S-3)

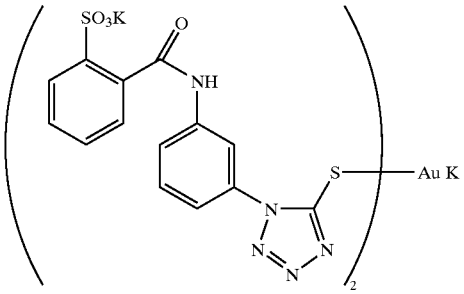

(S-4)

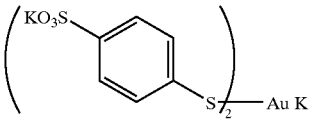

(S-5)

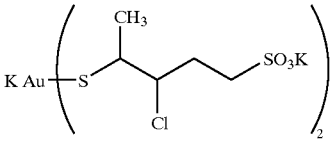

(S-6)

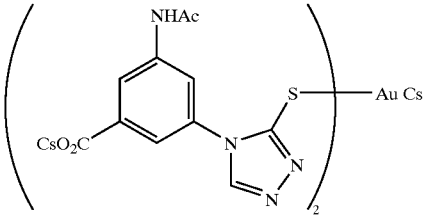

(S-7)

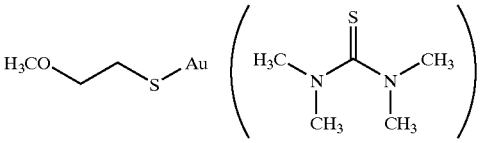

(S-8)

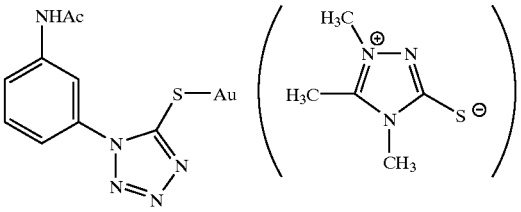

(S-9)

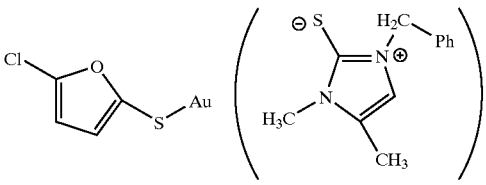

-continued (S-10)

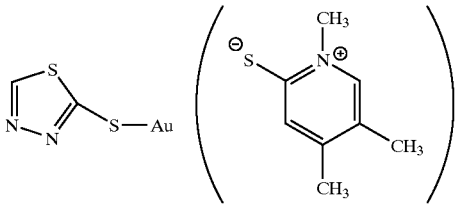

(S-11)

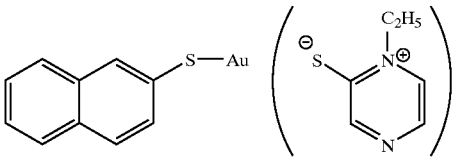

(S-12)

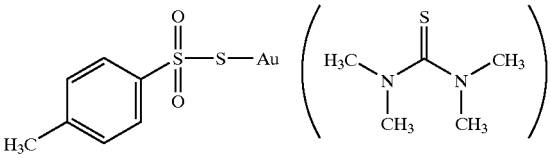

(S-13)

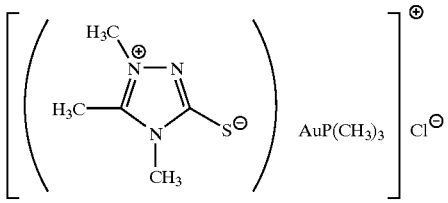

(S-14)

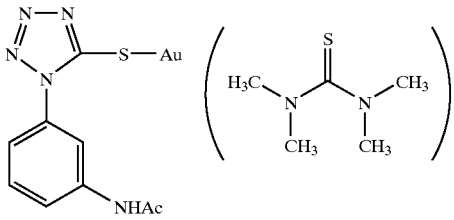

(S-15)

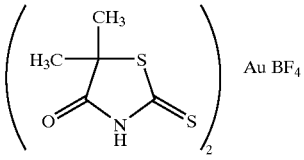

(S-16)

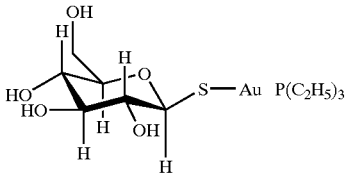

(S-17)

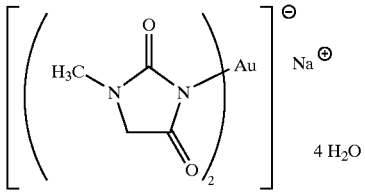

-continued (S-18)

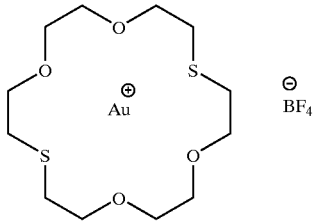

(S-19)

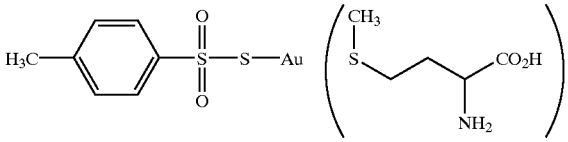

The gold sensitization in the present invention is usually conducted by adding the gold sensitizer and stirring the emulsion at high temperature (preferably 40° C. or more) for a definite period of time. Although the amount of the gold sensitizer added varies depending on various conditions, it is preferably from $1\times10^{-7}$ mol to $1\times10^{-4}$ mol, per mol of silver halide, as a measure.

In the present invention, a gold compound generally used (for example, a chloroaurate such as potassium chloroaurate, auric trichloride, potassium auric thiocyanate, potassium iodoaurate, tetracyanoauric acid, ammonium aurothiocyanate or pyridyltrichlorogold) can be used in combination with the above-mentioned compounds.

In the silver halide emulsion of the present invention, another chemical sensitization can be used in combination with the gold sensitization. The chemical sensitization methods which can be used in combination with the gold sensitization include sulfur sensitization, selenium sensitization, tellurium sensitization, noble metal sensitization using a compound other than gold and reduction sensitization. Compounds preferably used in the chemical sensitization are described in Japanese Patent Laid-Open No. 215272/1987, page 18, lower right column to page 22, upper right column.

For preventing fog during the production process, storage and photographic processing of the photographic material or stabilizing photographic properties, various compounds or their precursors can be added to the silver halide emulsion of the present invention. As specific examples of these compounds, there are preferably used compounds described in Japanese Patent Laid-Open No. 215272/1987, pages 39 to 72. Further, 5-arylamino-1,2,3,4-thiatriazole compounds (the aryl residue has at least one electron attractive group) described in European Patent 0447647 are also preferably used.

Further, in order to enhance the keeping quality of the silver halide emulsion in the present invention, hydroxamic acid derivatives described in Japanese Patent Laid-Open No. 109576/1999, cyclic ketones each having adjacent to a carbonyl group a double bond in which both ends are substituted by amino groups or hydroxyl groups (particularly, ketones represented by general formula (S1), paragraph Nos. 0036 to 0071, can be incorporated in the specification of this application) described in Japanese Patent Laid-Open No. 327094/1999, sulfo-substituted catechol and hydroquinones (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof) described in Japanese Patent Laid-Open No. 143011/1999, hydroxylamines represented by general formula (A) of U.S. Pat. No. 5,556,741 (the description in column 4, line 56 to column 11, line 22 of U.S. Pat. No. 5,556,741 is preferably applied also in this application, and incorporated as a part of the specification of this application) and water-soluble reducing agents represented by general formulas (I) to (III) in Japanese Patent Laid-Open No. 102045/1999 are also preferably used in the present invention.

For imparting so-called spectral sensitivity showing light sensitivity in desired light wavelength regions, spectral sensitizing dyes can be added to the silver halide emulsion of the present invention. The spectral sensitizing dyes used for spectral sensitization in blue, green and red regions include, for example, dyes described in F. M. Harmer, Heterocyclic Compounds-Cyanine Dyes and Related Compounds, John Wiley & Sons, New York, London (1964). As specific examples of the compounds and spectral sensitization methods, there are preferably used compounds and methods described in Japanese Patent Laid-Open No. 215272/1987, page 22, upper right column to page 38. Further, as red-sensitive spectral sensitizing dyes for the silver halide grains having a particularly high silver chloride content, spectral sensitizing dyes described in Japanese Patent Laid-Open No. 123340/1991 are very preferred from the view points of stability, strength of adsorption and temperature dependency of exposure.

The amount of these spectral sensitizing agents varies over a wide range, as the case may be. It is preferably from $0.5\times10^{-6}$ mol to $1.0\times10^{-2}$ mol, and more preferably from $1.0\times10^{-6}$ mol to $5.0\times10^{-5}$ mol, per mol of silver halide.

[Silver Halide Photographic Materials]

Then, the silver halide photographic materials in which the silver halide emulsions of the present invention are used will be described.

The silver halide photographic materials of the present invention may be either black-and-white materials or color materials. However, the silver halide emulsions of the present invention are preferably used in the silver halide color photographic materials.

The silver halide color photographic material in which the silver halide emulsion of the present invention are preferably used (hereinafter briefly referred to as "the photographic material of the present invention" in some cases) comprises a support having provided thereon at least one silver halide emulsion layer containing a yellow dye forming coupler, at least one silver halide emulsion layer containing a magenta dye forming coupler and at least one silver halide emulsion layer containing a cyan dye forming coupler, wherein at least one layer of the above-mentioned silver halide emulsion layers contains the emulsion of the present invention. In the present invention, the above-mentioned yellow dye forming coupler-containing silver halide emulsion layer functions as a yellow color forming layer, the above-mentioned magenta dye forming coupler-containing silver halide emulsion layer as a magenta color forming layer, and the above-mentioned cyan dye forming coupler-containing silver halide emulsion layer as a cyan color forming layer. It is preferred that the silver halide emulsions each contained in the above-mentioned yellow color forming layer, magenta color forming layer and cyan color forming layer have light sensitivity to light in mutually different wavelength regions (for example, light in blue, green and red regions).

The photographic material of the present invention may have a hydrophilic colloidal layer, an antihalation layer, an intermediate layer and a coloring layer, in addition to the above-mentioned yellow color forming layer, magenta color forming layer and cyan color forming layer, as desired.

Well-known materials for photography and additives can be used in the photographic material of the present invention.

For example, as a photographic support, there can be used a transparent support or a reflective support. As the transparent support, a support is preferably used in which an information recording layer is provided on a transparent film such as a cellulose nitrate film or a polyethylene terephthalate film, and further on a polyester film composed of 2,6-naphthalenedicarboxylic acid (NDCA) and ethylene glycol (EG) or a polyester film composed of NDCA, terephthalic acid and EG. As the reflective support, a reflective support is particularly preferred which is laminated with a plurality of polyethylene layers or polyester layers, at least one of such water-resistant resin layers (laminate layers) containing a white pigment such as titanium oxide.

More preferred examples of the reflective supports in the present invention include a support having a micropore-containing polyolefin layer on a paper substrate on the side to be provided with the silver halide emulsion layer. The polyolefin layer may be composed of multiple layers. In that case, it is more preferred that a polyolefin (for example, polypropylene or polyethylene) layer adjacent to a gelatin layer on the silver halide emulsion layer side has no micropores and that a polyolefin (for example, polypropylene or polyethylene) layer near to the side of the paper substrate has micropores. The density of the multiple polyolefin layers or the single polyolefin layer positioned between the paper substrate and the photographic constitution layers is preferably from 0.40 to 1.0 g/ml, and more preferably from 0.50 to 0.70 g/ml. Further, the thickness of the multiple polyolefin layers or the single polyolefin layer positioned between the paper substrate and the photographic constitution layers is preferably from 10 to 100 $\mu$m, and more preferably from 15 to 70 $\mu$m. Further, the ratio of the thickness of the polyolefin layer to that of the paper substrate is preferably from 0.05 to 0.2, and more preferably from 0.1 to 0.15.

From the viewpoint of enhancing rigidity of the reflective support, it is preferred that the polyolefin layer is provided on the side opposite to the photographic constitution layers (reverse side) of the above-mentioned paper substrate. In this case, the polyolefin layer on the reverse side is preferably a polyethylene or polypropylene layer whose surface is delustered, and more preferably a polypropylene layer. The thickness of the polyolefin layer on the reverse side is from 5 to 50 $\mu$m, and more preferably from 10 to 30 $\mu$m. Further, the density thereof is preferably from 0.7 to 1.1 g/ml. Preferred embodiments of the polyolefin layers provided on the paper substrates of the reflective supports in the present invention include examples described in Japanese Patent Laid-Open Nos. 333277/1998, 333278/1998, 52513/1999 and 65024/1999, and European Patents 0880065 and 0880066.

Further, it is preferred that the above-mentioned water-resistant resin layer contains a fluorescent brightening agent. A hydrophilic colloidal layer in which the above-mentioned fluorescent brightening agent is dispersed may be separately formed. As the above-mentioned fluorescent brightening agent, there can be preferably used a benzoxazole, coumarin or pyrazoline fluorescent brightening agent. More preferred is a benzoxazolylnaphthalene or benzoxazolylstilbene fluorescent brightening agent. Although there is no particular limitation on the amount thereof used, it is preferably from 1 to 100 mg/m$^2$. When the fluorescent brightening agent is mixed with the water-resistant resin, the mixing amount thereof is from 0.0005% to 3% by weight, and more preferably from 0.001% to 0.5% by weight, based on the resin.

The reflective support may be a support in which a hydrophilic colloidal layer containing a white pigment is formed on the transparent support or the reflective support as described above. The reflective support may be a support having a mirror reflective or class 2 diffused reflective metal surface.

Further, as the support used for the photographic material of the present invention, there may be used a white polyester support or a support having a white pigment-containing layer provided on the silver halide emulsion layer side of the support. Furthermore, in order to improve sharpness, an antihalation layer is preferably formed on the silver halide emulsion layer side or the reverse side of the support. In particular, it is preferred that the transparent density of the support is set within the range of 0.35 to 0.8 so as to be able to enjoy a display with both reflective light and transparent light.

In the photographic material of the present invention, for improving sharpness of an image, a dye decolorizable by processing (especially, an oxonol dye) described in EP-A-0,337,490, pages 27 to 76 is preferably added to the hydrophilic colloidal layer so that the optical reflection density of the photographic material at 680 nm becomes 0.70 or more, or titanium oxide surface treated with a dihydric to tetrahydric alcohol (for example, trimethylolethane) is preferably added in an amount of 12% by weight or more (more preferably in an amount of 14% by weight or more) to the water-resistant resin of the support.

In the photographic material of the present invention, for preventing irradiation or halation or improving safelight immunity, a dye decolorizable by processing (especially, an oxonol dye or a cyanine dye) described in EP-A-0,337,490, pages 27 to 76 is preferably added to the hydrophilic colloidal layer. Further, a dye described in European Patent 0,819,977 is also added in the present invention. Some of these water-soluble dyes deteriorate color separation or safelight immunity, when they are used in an increased amount. Water-soluble dyes described in Japanese Patent Laid-Open Nos. 127324/1993, 127325/1993 and 216185/1993 can be preferably used without deterioration of color separation.

In the present invention, a coloring layer decolorizable by processing is used in place of or in combination with the water-soluble dye. The coloring layer decolorizable by processing may be directly in contact with the emulsion layer, or may be arranged so as to come into contact with the emulsion layer through an intermediate layer containing a processing color stain preventing agent such as gelatin or hydroquinone. This coloring layer is preferably disposed as an under layer (on the support side) for the emulsion layer forming the same kind of primary color as the colored color. It is also possible to dispose all corresponding coloring layers individually for each primary color, or to arbitrarily select only some of these layers to dispose them. Further, it is also possible to dispose a coloring layer colored corresponding to plural primary color regions. As for the optical reflection density of the coloring layer, the optical density value at a wavelength showing the highest optical density in a wavelength region used for exposure (a visible light region of 400 nm to 700 nm in usual printer exposure, and in the case of scanning exposure, the wavelength of a scanning exposure light source used) is preferably from 0.2 to 3.0, more preferably from 0.5 to 2.5, and particularly preferably from 0.8 to 2.0.

In order to form the coloring layer, known method are applicable. Examples of the methods include a method of allowing a hydrophilic colloidal layer to contain a dye in the state of a fine solid grain dispersion as described in Japanese Patent Laid-Open No. 282244/1990, page 3, upper right column to page 8, and Japanese Patent Laid-Open No. 7931/1991, page 3, upper right column to page 11, lower left column, a method of mordanting an anionic dye to a cationic polymer, a method of allowing a dye to be adsorbed by fine grains of a silver halide or the like and fixing it in a layer, and a method of using colloidal silver as described in Japanese Patent Laid-Open No. 239544/1989. As for the method of dispersing a fine dye powder in the solid state, for example, a method of adding a fine dye powder which is substantially water-insoluble at pH 6 or less, but is substantially water-soluble at pH 8 or more is described in Japanese Patent Laid-Open No. 308244/1990, pages 4 to 13. Further, the method of mordanting the anionic dye to the cationic polymer is described in Japanese Patent Laid-Open No. 84637/1990, pages 18 to 26. Methods for preparing colloidal silver as a light absorber are shown in U.S. Pat. Nos. 2,688,601 and 3,459,563. Of these methods, the method of adding the fine dye powder and the method of using colloidal silver are preferred.

The photographic material of the present invention is used for a color negative film, a color positive film, a color reversal film, color reversal printing paper or color printing paper. Above all, it is preferred that the photographic material is used as the color printing paper. The color printing paper preferably comprises at least one yellow color forming silver halide emulsion layer, at least one magenta color forming silver halide emulsion layer and at least one cyan color forming silver halide emulsion layer. In general, these silver halide emulsion layers are disposed in the order of the yellow color forming silver halide emulsion layer, the magenta color forming silver halide emulsion layer and the cyan color forming silver halide emulsion layer from the support.

However, layer constitution different from this may be taken.

The-yellow coupler-containing silver halide emulsion layer may be disposed in any position on the support. However, when the yellow coupler-containing layer contains tabular silver halide grains, it is preferably formed in a position more apart from the support than at least one of the magenta coupler-containing silver halide emulsion layer and the cyan coupler-containing silver halide emulsion layer. From the viewpoints of the promotion of color development, the desilvering acceleration and a reduction in residual colors caused by sensitizing dyes, the yellow coupler-containing silver halide emulsion layer is preferably formed in a position most apart from the support, compared to the other silver halide emulsion layers. Further, from the viewpoint of a reduction in Blix fading, the cyan coupler-containing silver halide emulsion layer is preferably disposed as an intermediate layer between the other silver halide emulsion layers, and from the viewpoint of a reduction in light fading, the cyan coupler-containing silver halide emulsion layer is preferably disposed as the lowest layer. Further, yellow, magenta and cyan color forming layers may each be composed of two or three layers. For example, it is also preferred that a couple layer containing no silver halide emulsion is provided adjacent to the silver halide emulsion layer to allow it to act as a color forming layer, as described in Japanese Patent Laid-Open Nos. 75055/1992, 114035/1997 and 246940/1998 and U.S. Pat. No. 5,576,159.

As the silver halide emulsions, the other materials (such as additives) and photographic constitution layers (such as layer arrangement) applied in the present invention and the processing methods and the additives for processing applied for processing the light-sensitive materials, there are used preferably ones described in Japanese Patent Laid-Open Nos. 215272/1987 and 33144/1990 and EP-A-0,355,660, particularly preferably ones described in EP-A-0,355,660. Further, silver halide color photographic materials and methods for processing them described in Japanese Patent Laid-Open Nos. 34889/1993, 359249/1992, 313753/1992, 270344/1992, 66527/1993, 34548/1992, 145433/1992, 854/1990, 158431/1989, 90145/1990, 194539/1991 and 93641/1990 and EP-A-0,520,457 are also preferred.

The above-mentioned reflective supports and silver halide emulsions, foreign metal ionic species with which the silver halide grains are doped, storage stabilizers or antifoggants for the silver halide emulsions, chemical sensitization (sensitizers), spectral sensitization (spectral sensitizers), cyan, magenta and yellow couplers and emulsification dispersion methods thereof, color image keeping quality improvers (stain preventives and fading preventives), dyes (coloring layers), gelatin species, the layer constitution of the photographic materials and the coating pH of the photographic materials, which are particularly preferably applicable in the present invention, are described in respective portions of patents shown in Table 1 given below.

TABLE 1

| Element | Japanese Patent Laid-Open No. 104448/1995 | Japanese Patent Laid-Open No. 77775/1995 | Japanese Patent Laid-Open No. 301895/1995 |
|---|---|---|---|
| Reflective Support | Column 7, line 12 to column 12, line 19 | Column 35, line 43 to column 44, line 1 | Column 5, line 40 to column 9, line 26 |
| Silver Halide Emulsion | Column 72, line 29 to column 74, line 18 | Column 44, line 36 to column 46, line 29 | Column 77, line 48 to column 80, line 28 |
| Foreign Metal Ionic Species | Column 74, line 19 to the same column, line 44 | Column 46, line 30 to column 47, line 5 | Column 80, line 29 to column 81, line 6 |
| Storage Stabilizer or Antifoggant | Column 75, line 9 to the same column, line 18 | Column 47, line 20 to the same column, line 20 | Column 18, line 11 to column 31, line 37 (particularly mercapto heterocyclic compound) |
| Chemical Sensitization (Chemical Sensitizer) | Column 74, line 45 to column 75, line 6 | Column 47, line 7 to the same column, line 17 | Column 81, line 9 to the same column, line 17 |
| Spectral Sensitization (Spectral Sensitizer) | Column 75, line 19 to column 76, line 45 | Column 47, line 30 to column 49, line 6 | Column 81, line 21 to column 82, line 48 |
| Cyan Coupler | Column 12, line 20 to column 39, line 49 | Column 62, line 50 to column 63, line 16 | Column 88, line 49 to column 89, line 16 |
| Yellow Coupler | Column 87, line 40 to column 88, line 3 | Column 63, line 17 to the same column, line 30 | Column 89, line 17 to the same column, line 30 |
| Magenta Coupler | Column 88, line 4 to the same column, line 18 | Column 63, line 3 to column 64, line 11 | Column 31, line 34 to column 77, line 44 and column 88, line 32 to the same column, line 46 |
| Emulsification Dispersion Method of Coupler | Column 71, line 3 to column 72, line 11 | Column 61, line 36 to the same column, line 49 | Column 87, line 35 to the same column, line 48 |
| Color Image Keeping Quality | Column 39, line 50 to column 70, line 9 | Column 61, line 50 to column 62, line 49 | Column 87, line 49 to column 88, line 48 |

TABLE 1-continued

| Element | Japanese Patent Laid-Open No. 104448/1995 | Japanese Patent Laid-Open No. 77775/1995 | Japanese Patent Laid-Open No. 301895/1995 |
|---|---|---|---|
| Improver (Stain Preventive) | | | |
| Fading Preventive | Column 70, line 10 to column 71, line 2 | | |
| Dye (Coloring Agent) | Column 77, line 42 to column 78, line 41 | Column 7, line 14 to column 19, line 42 and column 50, line 3 to column 51, line 14 | Column 9, line 27 to column 18, line 10 |
| Gelatin Species | Column 78, line 42 to the same column, line 48 | Column 51, line 15 to the same column, line 20 | Column 83, line 13 to the same column, line 19 |
| Layer Constitution of Photographic Material | Column 39, line 11 to the same column, line 26 | Column 44, line 2 to the same column, line 35 | Column 31, line 38 to column 32, line 33 |
| Coating pH of Photographic Material | Column 72, line 12 to the same column, line 28 | | |
| Scanning Exposure | Column 76, line 6 to column 77, line 41 | Column 49, line 7 to column 50, line 2 | Column 82, line 49 to column 83, line 12 |
| Preservative in Developing Solution | Column 88, line 19 to column 89, line 22 | | |

As the cyan, magenta and yellow couplers used in the present invention, couplers described in Japanese Patent Laid-Open No. 215272/1987, page 91, upper right column, line 4 to page 121, upper left column, line 6, Japanese Patent Laid-Open No. 33144/1990, page 3, upper right column, line 14 to page 18, upper left column, the bottom line and page 30, upper right column, line 6 to page 35, lower right column, line 11, and EP-A-0,355,660, page 4, line 15 to line 27, page 5, line 30 to page 28, the bottom line, page 45, line 29 to line 31 and page 47, line 23 to page 63, line 50 are also useful.

Further, in the present invention, compounds represented by general formulas (II) and (III) of PCT International Publication No. WO98/33760 and general formula (D) of Japanese Patent Laid-Open No. 221825/1998 may be preferably added.

As the cyan dye forming coupler (briefly referred to as the "cyan coupler" in some cases) which can be used in the present invention, a pyrrolotriazole coupler is preferably used. Particularly preferred examples thereof include a coupler represented by general formula (I) or (II) of Japanese Patent Laid-Open No. 313324/1993, a coupler represented by general formula (I) of Japanese Patent Laid-Open No. 347960/1994 and couplers illustrated in these patents. Further, a phenol or naphthol cyan coupler is also preferred. For example, a cyan coupler represented by general formula (ADF) described in Japanese Patent Laid-Open No. 333297/1998 is preferred. As couplers other than the above, preferred are pyrroloazole cyan couplers described in European Patent 0,488,248 and EP-A-0,491,197, 2,5-diacylaminophenol couplers described in U.S. Pat. No. 5,888,716, and pyrazoloazole cyan couplers each having a electron attractive group or a hydrogen bond group at the 6-position described in U.S. Pat. Nos. 4,873,183 and 4,916,051. In particular, pyrazoloazole cyan couplers each having a carbamoyl group at the 6-position described in Japanese Patent Laid-Open Nos. 171185/1996, 311360/1996 and 339060/1996 are also preferred.

3-Hydroxypyridine cyan couplers described in EP-A-0,333,185 (a coupler obtained by giving a chlorine leaving group to a 4-equivalent coupler of coupler (42) enumerated as a specific example and making it 2-equivalent, coupler (6) and coupler (9) are particularly preferred among others), cyclic active methylene cyan couplers described in Japanese Patent Laid-Open No. 32260/1989 (coupler examples 38 and 34 enumerated as specific examples are particularly preferred among others), pyrrolopyrazole cyan couplers described in EP-A-0,456,226 and pyrroloimidazole cyan couplers described in EP-A-0,484,909, as well as diphenylimidazole cyan couplers described in Japanese Patent Laid-Open No. 33144/1990, can also be used.

Of these cyan couplers, a pyrroloazole cyan coupler represented by general formula (I) described in Japanese Patent Laid-Open No. 282138/1999 is particularly preferred. The description of paragraph numbers 0012 to 0059 of the patent, including exemplified cyan couplers (1) to (47), is applied to this application as such, and preferably incorporated as a part of the specification of this application.

As the magenta dye forming coupler (briefly referred to as the "magenta coupler" in some cases) used in the present invention, a 5-pyrazolone magenta coupler or a pyrazoloazole magenta coupler as described in known literatures shown in the above-mentioned table is used. However, in terms of hues, image stability and color formation, a pyrazolotriazole coupler in which a secondary or tertiary alkyl group is directly linked to a pyrazolotriazole ring at the 2-, 3- or 6-position as described in Japanese Patent Laid-Open No. 65245/1986, a pyrazoloazole coupler containing a sulfonamido group in its molecule as described in Japanese Patent Laid-Open No. 65246/1986, a pyrazoloazole coupler having an alkoxyphenylsulfonamido ballast group as described in Japanese Patent Laid-Open No. 147254/1986, and a pyrazoloazole coupler having an alkoxyl group or an aryloxy group at the 6-position as described in EP-A-226,849 or EP-A-294,785 are preferably used among others. In particular, a pyrazoloazole coupler represented by general formula (M-I) described in Japanese Patent Laid-Open No. 122984/1996 is preferred as the magenta coupler, and the description of paragraph numbers 0009 to 0026 of the patent is applied to this application as such, and incorporated as a part of the specification of this application. In addition to this, a pyrazoloazole coupler having steric hindrance groups at both the 3- and 6-positions described in European Patents 854,384 and 884,640 is also preferably used.

As the yellow dye forming coupler (briefly referred to as the "yellow coupler" in some cases), an acylacetamide yellow coupler described in EP-A-0,447,969, in which the acyl group has a 3- to 5-membered cyclic structure, a malondianilide yellow coupler having a cyclic structure described in EP-A-0,482,552, a pyrrole-2- or 3-yl or indole-2- or 3-ylcarbonylacetanilide coupler described in EP-A-953,872, 953,873, 953,874 and 953,875 or an acylacetamide yellow coupler having a dioxane structure described in U.S. Pat. No. 5,118,599, as well as compounds described in the above-mentioned table, is preferably used. Of these, an acylacetamide yellow coupler in which the acyl group is a 1-alkylcyclopropane-1-carbonyl group and a malondianilide yellow coupler in which one of the anilides constitutes a indoline ring are particularly preferably used. These couplers can be used either alone or in combination.

The coupler used in the present invention is preferably impregnated in a loadable latex polymer (for example, U.S. Pat. No. 4,203,716) in the presence (or in the absence) of a high boiling organic solvent described in the above table, or dissolved together with a water-insoluble and organic solvent-soluble polymer, and dispersed by emulsification in an aqueous solution of hydrophilic colloid. The water-insoluble and organic solvent-soluble polymers preferably used include homopolymers and copolymers described in U.S. Pat. No. 4,857,449, columns 7 to 15 and PCT International publication W88/00723, pages 12 to 30. The use of methacrylate or acrylamide polymers, particularly the use of acrylamide polymers is more preferred in terms of color image stability.

Although known color stain preventing agents can be used in the present invention, agents described in the following patents are preferred among others.

For example, high-molecular weight redox compounds described in Japanese Patent Laid-Open No. 333501/1993, phenidone or hydrazine compounds described in PCT International Publication No. WO98/33760 and U.S. Pat. No. 4,923,787 and white couplers described in Japanese Patent Laid-Open Nos. 249637/1993 and 282615/1998 and German Patent 19629142A1 can be used. in particular, when the pH of a developing solution is elevated to speed up development, redox compounds described in German Patent 19618786A1, EP-A-839,623, EP-A-842,975, German Patent 19806846A1 and French Patent 2760460A1 are also preferably used.

In the present invention, a compound having a triazine skeleton which has a high molar absorption coefficient is preferably used as an ultraviolet absorber. For example, compounds described in the following patents can be used. they are preferably added to light-sensitive layers and/or light-insensitive layers. For example, compounds can be used which described in Japanese Patent Laid-Open Nos. 3335/1971, 152776/1980, 197074/1993, 232630/1993, 307232/1993, 211813/1994, 53427/1996, 234364/1996, 239368/1996, 31067/1997, 115898/1998, 147577/1998 and 182621/1998, German Patent 19739797A, EP-A-711,804 and International Patent Publication No. 501291/1996.

As a binder or a protective colloid available in the photographic material of the present invention, gelatin is advantageously used. However, another hydrophilic colloid an also be used alone or in combination with gelatin. The amount of heavy metals such as iron, copper, zinc and manganese contained in preferred gelatin as impurities is preferably 5 ppm or less, and more preferably 3 ppm or less. Further, the amount of calcium contained in the photographic material is preferably 20 $mg/m^2$ or less, more preferably 10 $mg/m^2$ or less and most preferably 5 $mg/m^2$ or less.

In the present invention, in order to prevent various kinds of molds and bacteria which propagate in the hydrophilic colloidal layer to deteriorate an image, an antifungal agent and a microbiocide as described in Japanese Patent Laid-Open No. 271247/1988 are preferably added. Further, the coating pH of the photographic material is preferably from 4.0 to 7.0, and more preferably from 4.0 to 6.5.

In the present invention, from the viewpoints of improvement in coating stability of the photographic material, prevention of the generation of static electricity and control of the amount of electrification, a surfactant can be added to the photographic material. The surfactants include an anionic surfactant, a cationic surfactant, a betaine surfactant and nonionic surfactant. Examples thereof include surfactants described in Japanese Patent Laid-Open No. 333492/1993. As the surfactant used in the present invention, a fluorine atom-containing surfactant is preferred. The fluorine atom-containing surfactant may be used either alone or in combination with another known surfactant. It is preferred that the surfactant is used in combination with another known surfactant. Although there is no particular limitation on the amount of the surfactant added, it is generally from $1\times10^{-5}$ to 1 g/m$^2$, preferably from $1\times10^{-4}$ to $1\times10^{-1}$ g/m$^2$, and more preferably from $1\times10^{-3}$ to $1\times10^{-2}$ g/m$^2$.

An image can be formed on the photographic material of the present invention by an exposure process in which light is irradiated according to image information and a developing process in which the above-mentioned light-irradiated photographic material is developed.

The photographic material of the present invention is not only used in a print system using an ordinary negative printer, but also suitable for a scanning exposure system using a cathode ray tube (CRT). The cathode ray tube exposure apparatus is simple and compact, allowing low cost, compared to an apparatus using a laser. Further, optical axes and colors are also easily adjusted. Various emitters showing luminescence in spectrum regions are used as needed in the cathode ray tube used for image exposure. For example, any one of red, green and blue luminous bodies, or a mixture of two or more of them is used. The spectrum regions are not limited to the above-mentioned red, green and blue regions, and a luminous body emitting light in a yellow orange, purple or infrared region is also used. In particular, a cathode ray tube in which these luminous bodies are mixed to emit white light is often used.

When the photographic material has a plurality of light-sensitive layers having different spectral sensitivity distributions, and the cathode ray tube also has luminous bodies showing luminescence in a plurality of spectrum regions, the photographic material may be exposed to a plurality of colors at once, that is to say, image signals of a plurality of colors may be supplied to the cathode ray tube to emit light from a tube face. A method of sequentially supplying image signals for respective colors to sequentially emit light for the respective colors, and conducting exposure through a film cutting colors other than the subject color (sequential exposure) may be employed. In general, sequential exposure is preferred to enhance image quality, because a high resolution cathode ray tube can be used.

In the photographic material of the present invention, a digital scanning exposure system using monochromatic high-density light such as a gas laser, a light emitting diode, a semiconductor laser or a second harmonic generation light source (SHG) in which a semiconductor laser or a solid laser using a semiconductor laser as an excitation light source is combined with a nonlinear optical crystal is preferably used. In order to make the system compact and cheap, the use of the semiconductor or the second harmonic generation light source (SHG) in which the semiconductor laser or the solid laser is combined with the nonlinear optical crystal is preferred. In particular, in order to design a compact, cheap apparatus having a long life and high stability, the use of the semiconductor laser is preferred, and the use of the semiconductor laser as at least one of the exposure light sources is preferred.

The silver halide color photographic material containing the silver halide emulsion of the present invention is preferably exposed imagewise to a coherent light of a blue laser having a luminous wavelength of 420 nm to 460 nm. Of the blue lasers, the use of a blue semiconductor laser is particularly preferred.

Specific examples of the laser light sources preferably used include a blue semiconductor laser having a wavelength of 430 to 450 nm (presented by Nichia Kagaku Co., Ltd. at the 48th Applied Physics-Related Cooperative Lecture Meeting, March, 2001), a blue laser having a wavelength of about 470 nm taken out by wavelength conversion of a semiconductor laser (oscillation wavelength: about 940 nm) with an SHG crystal of $LiNbO_3$ having a waveguide-like inverted domain structure, a green laser having a wavelength of about 530 nm taken out by wavelength conversion of a semiconductor laser (oscillation wavelength: about 1060 nm) with an SHG crystal of $LiNbO_3$ having a waveguide-like inverted domain structure, a red semiconductor laser having a wavelength of about 685 nm (Hitachi Type No. HL6738MG) and a red semiconductor laser having a wavelength of about 650 nm (Hitachi Type No. HL6501MG).

When such a scanning exposure light source is used, the spectral sensitivity maximum wavelength of the photographic material of the present invention can be arbitrarily established according to the wavelength of a light source for scanning exposure used. The second harmonic generation light source (SHG) in which the solid laser using the semiconductor laser as the excitation light source or the semiconductor laser is combined with the nonlinear optical crystal can halve the oscillation wavelength of the laser, so that red light and green light can be obtained. Accordingly, it is possible to allow the ordinary three wavelength regions of blue, green and red to have the spectral sensitivity maximum of the photographic material. When the exposure time in such scanning exposure is defined as the time required to expose a pixel size at a pixel density of 400 dpi, the exposure time is preferably $10^{-4}$ second or less, and more preferably $10^{-6}$ second or less.

The silver halide color photographic material of the present invention can be preferably used in combination with exposure and development systems described in the following known literatures. The development systems include an automatic print and development system described in Japanese Patent Laid-Open No. 333253/1998, a photographic material transfer apparatus described in Japanese Patent Laid-Open No.10206/2000, a recording system containing an image scanner described in Japanese Patent Laid-Open No. 215312/1999, an exposure system comprising a color image recording system described in Japanese Patent Laid-Open Nos. 88619/1999 and 202950/1998, and a digital photoprint system containing a remote diagnosis system described in Japanese Patent Laid-Open No. 210206/1998.

Preferred scanning exposure systems applicable to the present invention are described in the patents shown in the above table in detail.

When the photographic material of the present invention is subjected to printer exposure, the use of a band stop filter described in U.S. Pat. No. 4,880,726 is preferred. Light color stain is removed thereby to significantly improve color reproducibility.

In the present invention, as described in EP-A-0,789,270 and EP-A-0,789,480, preexposure may be previously carried out using a yellow microdot pattern before image information is imparted, thereby conducting copy regulation.

In processing the photographic material of the present invention, processing materials and processing methods described in Japanese Patent Laid-Open No. 207250/1990, page 26, lower right column, line 2 to page 34, upper right column, line 9, and Japanese Patent Laid-Open No. 97355/1992, page 5, upper left column, line 17 to page 18, lower right column, line 20 are preferably applicable. As the preservatives used in the developing solutions, there are preferably used compounds described in the patent shown in the above table.

The silver halide photographic material containing the silver halide emulsion of the present invention are preferably applied as a photographic material having rapid processability. When rapid processing is conducted, the color development time is preferably 30 seconds or less, more preferably from 6 seconds to 25 seconds, and still more preferably from 6 seconds to 20 seconds. Similarly, the bleaching-fixing time is preferably 30 seconds or less, more preferably from 6 seconds to 25 seconds, and still more preferably from 6 seconds to 20 seconds. Further, the washing or stabilizing time is preferably 60 seconds or less, and more preferably from 6 seconds to 40 seconds.

The color development time means the time taken from the entrance of the photographic material into a color developing solution to the entrance thereof into a bleaching-fixing solution of the subsequent processing stage. For example, when the photographic material is processed with an automatic processor, the total of both the time for which the photographic material is immersed in the color developing solution (so-called submerged time) and the time for which the photographic material leaving the color-developing solution is conveyed in the air to a bleaching-fixing bath of the subsequent processing stage (so-called midair time) is called the color development time. Similarly, the bleaching-fixing time means the time taken from the entrance of the photographic material into a bleaching-fixing solution to the entrance thereof into a washing or stabilizing bath of the subsequent processing stage. Further, the washing or stabilizing time means the time for which the photographic material entering the washing or stabilizing solution is in the solution toward a drying stage (so-called submerged time).

As a method for developing the photographic material of the present invention after exposure, there can be used a heat development process using no processing solution, as well as a wet process such as a conventional developing method using a developing solution containing an alkali agent and a developing agent, or a method in which the photographic material containing a developing agent is developed with an activator solution such as an alkali solution. In particular, according to the activator method, the processing solution contains no developing agent, so that the processing solution is easily controlled and handled. Further, the load in waste fluid treatment is reduced. This method is therefore also preferred from the viewpoint of environmental conservation.

The developing agents or precursors thereof preferably contained in the photographic materials in the activator method are, for example, hydrazine compounds described in Japanese Patent Laid-Open Nos. 234388/1996, 152686/1997, 152693/1997, 211814/1997 and 160193/1997.

Further, a development method of reducing the amount of silver coated of the photographic material and conducting image amplification processing (intensification processing) using hydrogen peroxide is also preferably used. In particular, it is preferred that this method is used in the activator method. Specifically, an image formation method using a hydrogen peroxide-containing activator solution described in Japanese Patent Laid-Open Nos. 297354/1996 and 152695/1997 is preferably used. Silver removal processing is conducted after processing with the activator solution in the above-mentioned activator method. However, in the image amplification processing method using the photographic material having a low silver content, a simple method of washing or stabilization can be conducted omitting the silver removal processing. Further, in a system of reading image information from the photographic material with a scanner, a processing pattern requiring no silver removal processing can be employed even when the photographic material having a high silver content such as the photographic material for shooting is used.

In the present invention, there can be used known activator solutions, silver removal solutions (bleaching/fixing solutions), processing materials of washing and stabilizing solutions and processing methods, preferably described in *Research Disclosure*, Item 36544, pages 536 to 541 (September, 1994) and Japanese Patent Laid-Open No. 234388/1996.

EXAMPLES

Example 1

Emulsion 1—1; Preparation (1) of Cubic Silver Chloride Sample (Comparison)

A 3% aqueous solution of lime-treated gelatin (1000 ml) was adjusted to pH 5.5 and pCl 1.7, and an aqueous solution containing 2.12 mol of silver nitrate and an aqueous solution containing 2.2 mol of sodium chloride were concurrently added thereto at 66° C. with vigorous stirring. From the time when the addition of silver nitrate reached 80% to the time when it reached 90%, potassium chloride was added with vigorous mixing so as to give a content of 2 mol % per mol of silver halide in a final product. At the time when the addition of silver nitrate reached 90%, an aqueous solution of potassium iodide was added with vigorous mixing in an amount to give an I content of 0.2 mol % per mol of silver halide in the final product. After desilvering treatment was carried out at 40° C., 168 g of lime-treated gelatin was added to adjust the pH and the pCl to 5.5 and 1.8, respectively. Thus, an emulsion of cubic silver iodobromochloride grains having a equivalent sphere diameter of 0.75 $\mu$m and a coefficient of variation of 11% was obtained.

This emulsion was dissolved at 40° C., and sodium thiosulfonate was added thereto in an amount of $2\times10^{-5}$ mol per mol of silver halide. Then, using sodium thiosulfate pentahydrate as a sulfur sensitizer, and gold (I) borate tetrafluoride bis(1,2,5-trimethyl-1,2,4-triazolium-3-thiolate as a gold sensitizer, ripening was conducted at 60° C. so as to give optimum results. After the temperature was lowered to 40° C., sensitizing dye A was added in an amount of $2\times10^{-4}$ mol per mol of silver halide, sensitizing dye B in an amount of $1\times10^{-4}$ mol per mol of silver halide, 1-phenyl-5-methylureidephenyl-5-mercaptotetrazole in an amount of $2\times10^{-4}$ mol per mol of silver halide, and potassium bromide in an amount of $2\times10^{-3}$ mol per mol of silver halide. The emulsion thus obtained was named emulsion 1—1.

(Sensitizing Dye A)

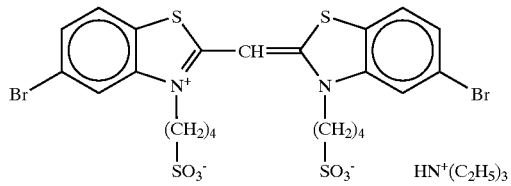

(Sensitizing Dye B)

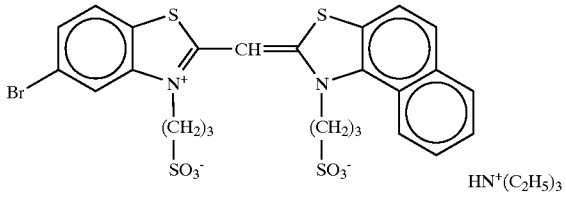

Emulsion 1–2; Preparation of Cubic Silver Chloride Sample Doped with $[IrCl_6]^{3-}$ (Comparison)

Emulsion 1–2 was prepared in the same manner as with emulsion 1—1 with the exception that hexachloroiridium was added to a layer of 92% to 98% from the center of the grain by the grain volume, in an amount of $2\times10^{-8}$ mol based on the total amount of silver added.

Emulsion 1–3; Preparation of Cubic Silver Chloride Sample Doped with $[IrCl_5(thia)]^{2-}$ (Comparison)

Emulsion 1–3 was prepared in the same manner as with emulsion 1—1 with the exception that pentachloro-(thiazole) iridium was added to a layer of 92% to 98% from the center of the grain by the grain volume, in an amount of $3\times10^{-7}$ mol based on the total amount of silver added.

Emulsion 1–4; Preparation of Cubic Silver Chloride Sample Doped with $[IrCl_6(thiourea)]^{2-}$ (Comparison)

Emulsion 1–4 was prepared in the same manner as with emulsion 1—1 with the exception that pentachloro-(thiourea) iridium was added to a layer of 92% to 98% from the center of the grain by the grain volume, in an amount of $6\times10^{-7}$ mol based on the total amount of silver added.

Emulsion 1–5; Preparation of Cubic Silver Chloride Sample Doped with $[IrCl_6(S\text{-}Me\text{-}thiourea)]^{2-}$ (Invention)

Emulsion 1–5 was prepared in the same manner as with emulsion 1—1 with the exception that pentachloro-(S-methylthiourea) iridium was added to a layer of 92% to 98% from the center of the grain by the grain volume, in an amount of $6\times10^{-7}$ mol based on the total amount of silver added.

Emulsions 1–6 and 1–7; Preparation of Cubic Silver Chloride Samples Doped with $[IrCl_5(S{=}P(NH_2)_2(OH))^{2-}$ and $[IrCl_5(2,5\text{-}(CH_3)_2\text{-thiadiazole})]^{2-}$, Respectively (Invention)

Emulsions 1–6 and 1–7 were prepared in the same manner as with emulsion 1—1 with the exception that pentachloro-(diaminohydroxythiophsophonic acid)iridium and pentachloro(2,5-dimethyl-1,3,4-thiadiazole)iridium were each added to a layer of 92% to 98% from the center of the grain by the grain volume, in an amount of $1\times10^{-6}$ mol based on the total amount of silver added.

Emulsions 1–8 and 1–9; Preparation of Cubic Silver Chloride Samples Doped with $[IrCl_5(5\text{-}Cl\text{-thiatriazole})]^{2-}$ and $[IrCl_5(2\text{-}Cl\text{-}5\text{-}CH_3\text{-thiadiazole})]^{2-}$, Respectively (Invention)

Emulsions 1–8 and 1–9 were prepared in the same manner as with emulsion 1—1 with the exception that pentachloro-(5-chloro-1,2,3,4-thiatriazole)iridium and pentachloro-(2-chloro-5-methyl-1,3,4-thiadiazole) iridium were each added to a layer of 92% to 98% from the center of the grain by the grain volume, in an amount of $3\times10^{-7}$ mol based on the total amount of silver added.

Emulsions 1–10 and 1–11; Preparation of Cubic Silver Chloride Samples Doped with $[IrCl_5(2\text{-}Cl\text{-}5\text{-}F\text{-thiatriazole})]^{2-}$ and $[IrCl_5(2\text{-}Br\text{-}5\text{-}F\text{-thiadiazole})]^{2-}$, Respectively (Invention)

Emulsions 1–10 and 1–11 were prepared in the same manner as with emulsion 1—1 with the exception that pentachloro-(2-chloro-5-fluoro-1,3,4-thiatriazole)iridium and pentachloro(2-bromo-5-fluoro-1,3,4-thiadiazole) iridium were each added to a layer of 92% to 98% from the center of the grain by the grain volume, in an amount of $6\times10^{-7}$ mol based on the total amount of silver added.

After corona discharge treatment was applied onto a surface of a support in which both faces of paper were covered with a polyethylene resin, a gelatin undercoat layer containing sodium dodecylbenzenesulfonate was provided, and first to seventh photographic constitution layers were further provided in turn to prepare sample (101) of a silver halide color photographic material having layer constitution shown below. Coating solutions for the respective photographic constitution layers were prepared as described below.

Preparation of Coating Solution for First Layer

Yellow coupler (ExY) (57 g), 7 g of color image stabilizer (Cpd-1), 4 g of color image stabilizer (Cpd-2), 7 g of color image stabilizer (Cpd-3) and 2 g of color image stabilizer (Cpd-8) were dissolved in 21 g of solvent (Solv-1) and 80 ml of ethyl acetate, and the resulting solution was dispersed by emulsification in 220 g of a 23.5 wt % aqueous solution of gelatin containing 4 g of sodium dodecylbenzenesulfonate with a high-speed stirring emulsifier (dissolver), followed by addition of water to prepare 900 g of emulsified dispersion A.

On the other hand, emulsified dispersion A and emulsion 1—1 were mixed and dissolved to prepare a coating solution for the first layer having a composition described later. The amount of the emulsion coated indicates the amount coated converted to the amount of silver.

Coating solutions for the second to seventh layers were also prepared in the same manner as with the coating solution for the first layer. As gelatin hardeners for the respective layers, there were used 1-oxy-3,5-dichloro-s-triazine sodium salts (H-1), (H-2) and (H-3). Further, Ab-1, Ab-2, Ab-3 and Ab-4 were added to the respective layers in amounts of 15.0 mg/m$^2$, 60.0 mg/m$^2$, 5.0 mg/m$^2$ and 10.0 mg/m$^2$ respectively.

Hardener (H-1)

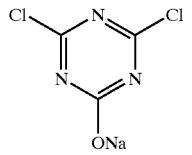

(Used in an amount of 1.4 wt % per gelatin)

Hardener (H-2)

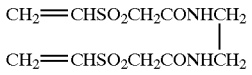

Hardener (H-3)

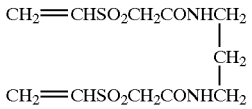

Preservative (Ab-1)

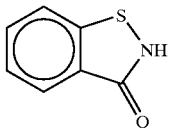

Preservative (Ab-2)

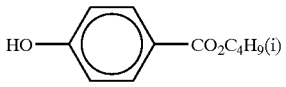

-continued

Preservative (Ab-3)

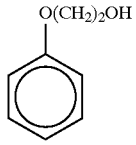

Preservative (Ab-4)

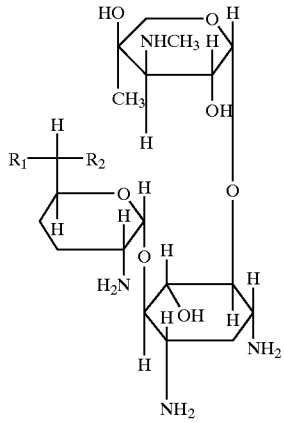

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A 1:1:1:1 mixture of a, b, c and d (molar ratio)

The following spectral sensitizing dyes were each used in silver chlorobromide emulsions of green-sensitive and red-sensitive emulsion layers, respectively.

Green-Sensitive Emulsion Layer (Sensitizing Dye D)

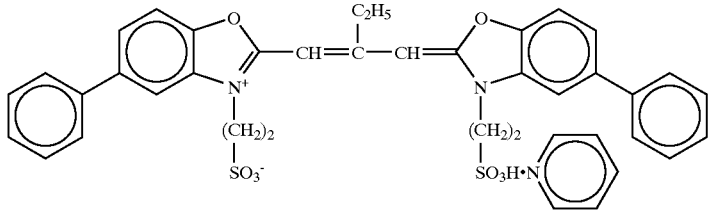

(Sensitizing Dye E)

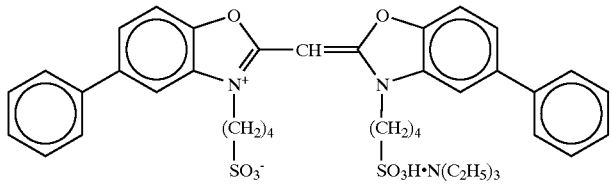

(Sensitizing Dye F)

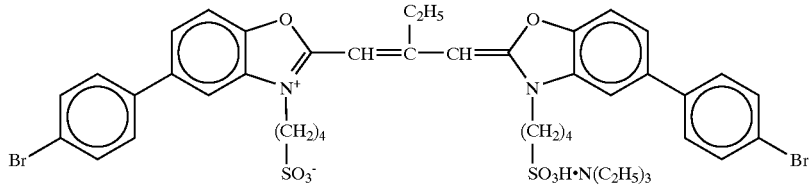

Sensitizing dye D was added to a large-size emulsion in an amount of $3.0\times10^{-4}$ mol, and to a small-size emulsion in an amount of $3.6\times10^{-4}$ mol, per mol of silver halide. Sensitizing dye E was added to a large-size emulsion in an amount of $4.0\times10^{-5}$ mol, and to a small-size emulsion in an amount of $7.0\times10^{-5}$ mol, per mol of silver halide. Further, sensitizing dye F was added to a large-size emulsion in an amount of $2.0\times10^{-4}$ mol, and to a small-size emulsion in an amount of $2.8\times10^{-4}$ mol, per mol of silver halide.

Red-Sensitive Emulsion Layer.

(Sensitizing Dye G)

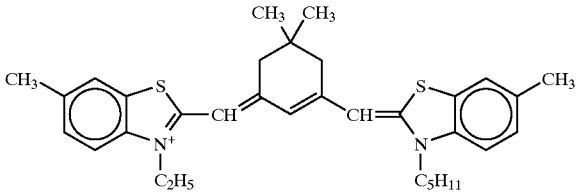

(Sensitizing Dye H)

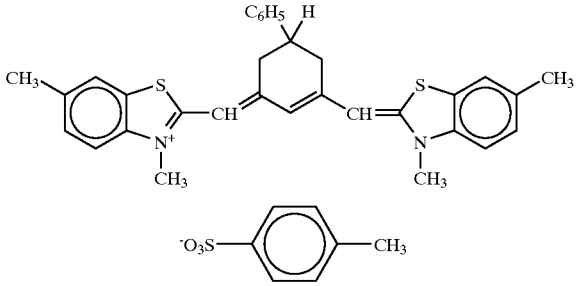

Sensitizing dyes G and H were each added to a large-size emulsion in an amount of $8.0\times10^{-5}$ mol, and to a small-size emulsion in an amount of $10.7\times10^{-5}$ mol, per mol of silver halide.

Further, the following compound I was added to the red-sensitive emulsion layer in an amount of $3.0\times10^{-3}$ mol per mol of silver halide.

Compound I

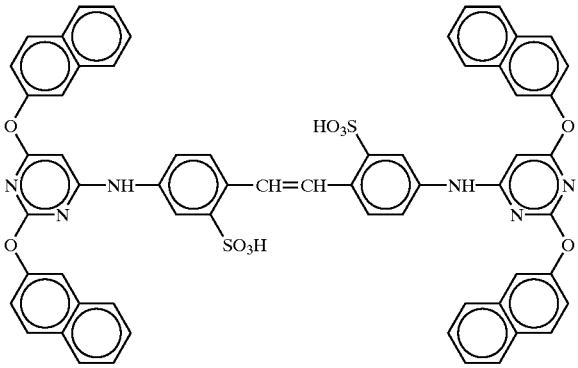

Further, 1-(5-methylureidophenyl)-5-mercaptotetrazole was added to the green-sensitive emulsion layer and the red-sensitive emulsion layer in amounts of $1.0\times10^{-3}$ mol and $5.9\times10^{-4}$ mol per mol of silver, respectively. Furthermore, it was added to the second, fourth, sixth and seventh layers so as to give 0.2 mg/m$^2$, 0.2 mg/m$^2$, 0.6 mg/m$^2$ and 0.1 mg/m$^2$, respectively.

Further, 4-hydroxy-6-methyl-1,3,3a,7-tetraazaindene was added to the blue-sensitive layer and the green-sensitive layer in amounts of $1\times10^{-4}$ mol and $2\times10^{-4}$ mol per mol of silver, respectively.

Still further, 0.05 g/m$^2$ of a methacrylic acid-butyl acrylate copolymer latex (weight ratio: 1:1, average molecular weight: 200,000 to 400,000) was added to the red-sensitive emulsion layer.

Furthermore, disodium catechol-3,5-disulfonate was added to the second, fourth and sixth layers so as to give 6 mg/m$^2$, 6 mg/m$^2$ and 18 mg/m$^2$, respectively.

In order to prevent irradiation, the following dyes (the values in parentheses indicate the amount of the dyes added) were added.

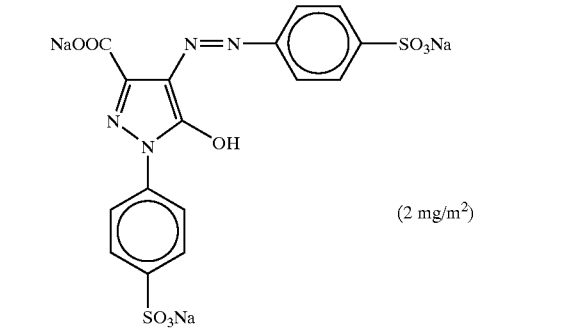

(2 mg/m$^2$)

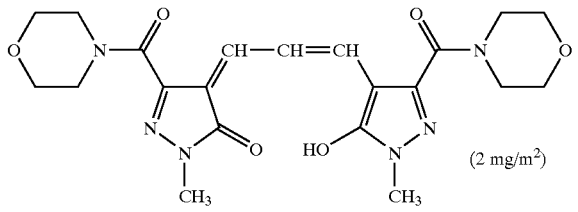

(2 mg/m$^2$)

-continued

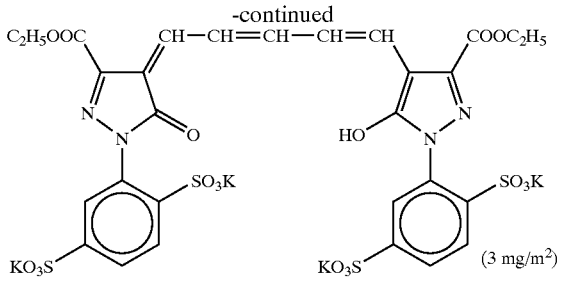

(3 mg/m$^2$)

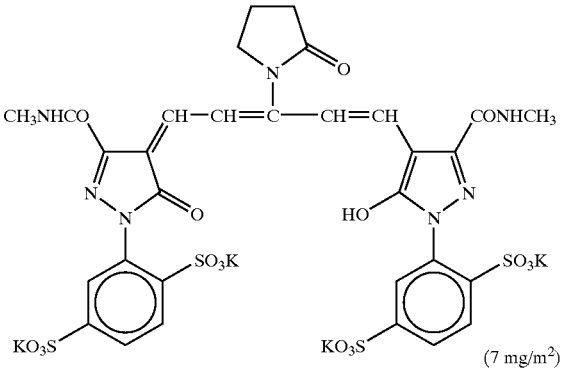

(7 mg/m$^2$)

Layer Constitution

The constitution of each layer will be shown below. Figures indicate the amount coated, and for silver halide emulsions, figures indicate the amount coated converted to the amount of silver.

Support

Polyethylene Resin-Laminated Paper

A polyethylene resin on the first layer side contains a white pigment (TiO2 content: 16% by weight, ZnO content: 4% by weight), a fluorescent brightening agent (4,4'-bis(5-methylbenzoxazolyl)stilbene content: 0.03% by weight) and a bluish dye (ultramarine).

| | |
|---|---|
| The First Layer: (Blue-Sensitive Emulsion Layer) | |
| Emulsion 1-1 | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-8) | 0.02 |
| Solvent (Solv-1) | 0.21 |
| The Second Layer: (Color Stain Preventing Layer) | |
| Gelatin | 0.99 |
| Color Stain Preventing Agent (Cpd-4) | 0.09 |
| Color Image Stabilizer (Cpd-5) | 0.018 |
| Color Image Stabilizer (Cpd-6) | 0.13 |
| Color Image Stabilizer (Cpd-7) | 0.01 |
| Solvent (Solv-1) | 0.06 |
| Solvent (Solv-2) | 0.22 |
| The Third Layer: (Green-Sensitive Emulsion Layer) | |
| Silver Chlorobromide Emulsion Em-1 (A 1:3 mixture (silver molar ratio) of a gold sulfur-sensitized large-size emulsion containing cubic grains having average grain size of 0.45 μm and a small-size emulsion containing grains having average grain size of 0.35 μm. The coefficient of variation of the grain size distribution is 0.10 for the large-size emulsion, and 0.08 for the small-size emulsion. For both the emulsions, the grain contains 0.15 mol % of silver iodide in the vicinity of a surface thereof, and locally contain 0.4 mol % of silver bromide in a surface thereof.) | 0.14 |

-continued

| | |
|---|---|
| Gelatin | 1.36 |
| Magenta Coupler (ExM) | 0.15 |
| Ultraviolet Absorber (UV-A) | 0.14 |
| Color Image Stabilizer (Cpd-2) | 0.02 |
| Color Image Stabilizer (Cpd-4) | 0.002 |
| Color Image Stabilizer (Cpd-6) | 0.09 |
| Color Image Stabilizer (Cpd-8) | 0.02 |
| Color Image Stabilizer (Cpd-9) | 0.03 |
| Color Image Stabilizer (Cpd-10) | 0.01 |
| Color Image Stabilizer (Cpd-11) | 0.0001 |
| Solvent (Solv-3) | 0.11 |
| Solvent (Solv-4) | 0.22 |
| Solvent (Solv-5) | 0.20 |

The Fourth Layer: (Color Stain Preventing Layer)

| | |
|---|---|
| Gelatin | 0.71 |
| Color Stain Preventing Agent (Cpd-4) | 0.06 |
| Color Image Stabilizer (Cpd-5) | 0.013 |
| Color Image Stabilizer (Cpd-6) | 0.10 |
| Color Image Stabilizer (Cpd-7) | 0.007 |
| Solvent (Solv-1) | 0.04 |
| Solvent (Solv-2) | 0.16 |

The Fifth Layer: (Red-Sensitive Emulsion Layer)

| | |
|---|---|
| Silver Chlorobromide Emulsion Em-2 (A 5:5 mixture (silver molar ratio) of a gold sulfur-sensitized large-size emulsion containing cubic grains having average grain size of 0.40 μm and a small-size emulsion containing grains having average grain size of 0.30 μm. The coefficient of variation of the grain size distribution is 0.09 for the large-size emulsion, and 0.11 for the small-size emulsion. For both the emulsions, the grain contains 0.1 mol % of silver iodide in the vicinity of a surface thereof, and locally contain 0.8 mol % of silver bromide in a surface thereof.) | 0.12 |
| Gelatin | 1.11 |
| Cyan Coupler (ExC-2) | 0.13 |
| Cyan Coupler (ExC-3) | 0.03 |
| Color Image Stabilizer (Cpd-1) | 0.05 |
| Color Image Stabilizer (Cpd-6) | 0.06 |
| Color Image Stabilizer (Cpd-7) | 0.02 |
| Color Image Stabilizer (Cpd-9) | 0.04 |
| Color Image Stabilizer (Cpd-10) | 0.01 |
| Color Image Stabilizer (Cpd-14) | 0.01 |
| Color Image Stabilizer (Cpd-15) | 0.12 |
| Color Image Stabilizer (Cpd-16) | 0.03 |
| Color Image Stabilizer (Cpd-17) | 0.09 |
| Color Image Stabilizer (Cpd-18) | 0.07 |
| Solvent (Solv-5) | 0.15 |
| Solvent (Solv-8) | 0.05 |

The Sixth Layer: (Ultraviolet Absorbing Layer)

| | |
|---|---|
| Gelatin | 0.46 |
| Ultraviolet Absorber (UV-B) | 0.45 |
| Compound (S1-4) | 0.0015 |
| Solvent (Solv-7) | 0.25 |

The Seventh Layer: (Protective Layer)

| | |
|---|---|
| Gelatin | 1.00 |
| Acrylic Modified Copolymer of Polyvinyl Alcohol (degree of modification: 17%) | 0.04 |
| Liquid Paraffin | 0.02 |
| Surfactant (Cpd-13) | 0.01 |

Yellow Coupler (ExY):

A 70:30 mixture (molar ratio) of

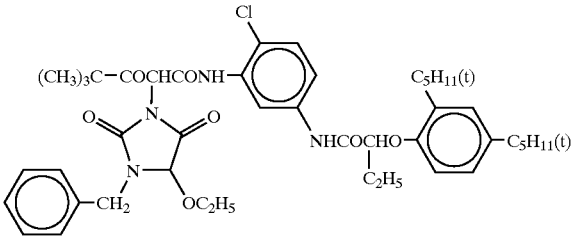

-continued and

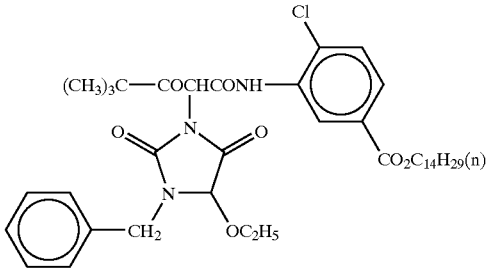

Magenta Coupler (ExM):

A 40:40:20 mixture of

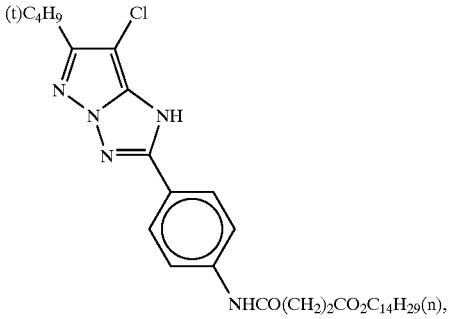

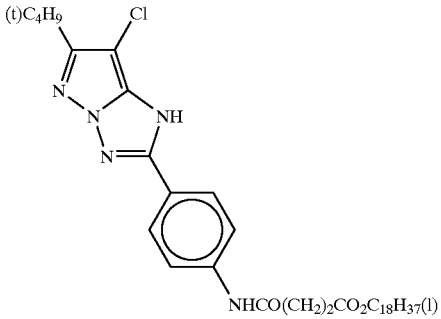

and

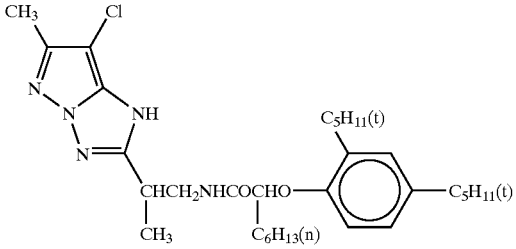

Cyan Coupler (ExC-2):

-continued

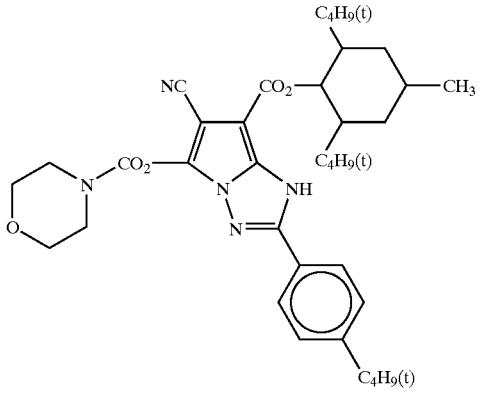

Cyan Coupler (ExC-3):
A 50:25:25 mixture (molar ratio) of

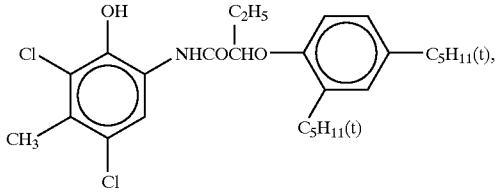

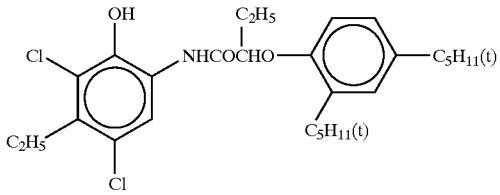

and

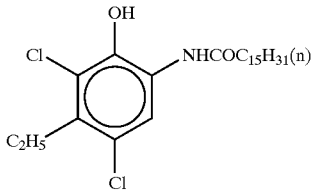

Color Image Stabilizer (Cpd-1):

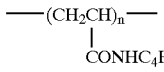

number average molecular weight: 60,000

Color Image Stabilizer (Cpd-2):

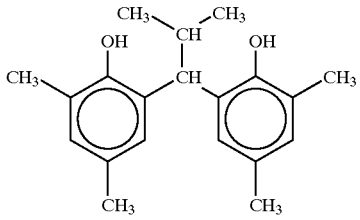

Color Image Stabilizer (Cpd-3):

-continued

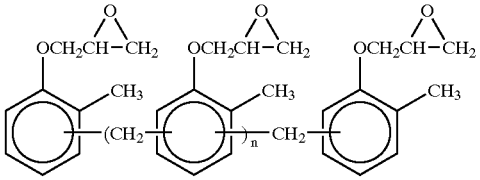

n = 7 to 8 (mean value)

Color Stain Preventing Agent (Cpd-4):

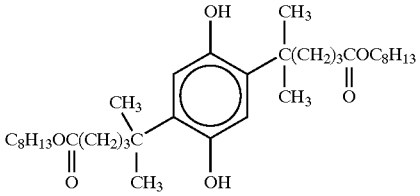

Color Image Stabilizer (Cpd-5):

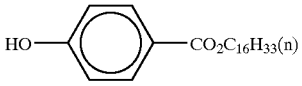

Color Image Stabilizer (Cpd-6):

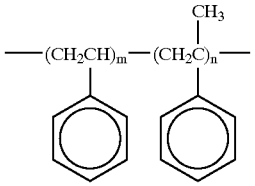

number average molecular weight: 600
m/n = 10/90

Color Image Stabilizer (Cpd-7):

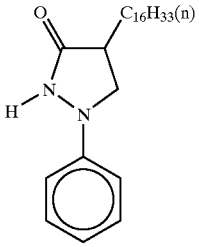

Color Image Stabilizer (Cpd-8):

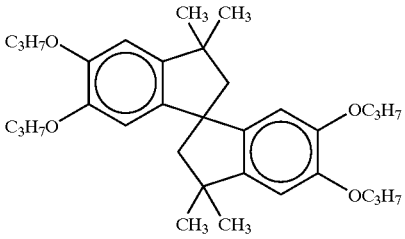

Color Image Stabilizer (Cpd-9):

-continued

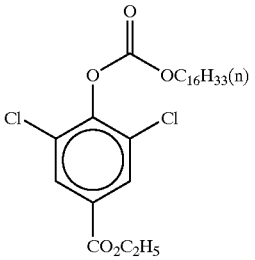

Color Image Stabilizer (Cpd-10):

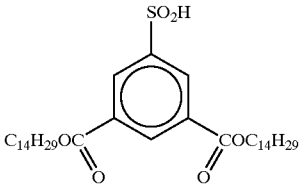

Color Image Stabilizer (Cpd-11):

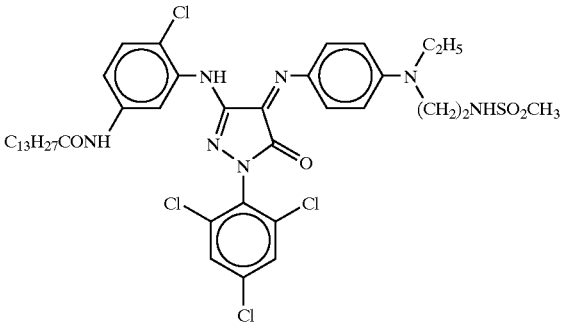

Surfactant (Cpd-13):

A 7:3 mixture (molar ratio) of

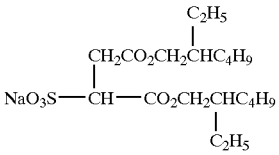

and

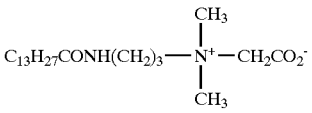

Color Image Stabilizer (Cpd-14):

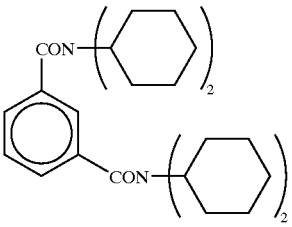

Color Image Stabilizer (Cpd-15):

-continued

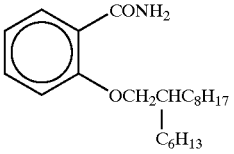

Color Image Stabilizer (Cpd-16):

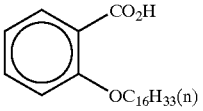

Color Image Stabilizer (Cpd-17):

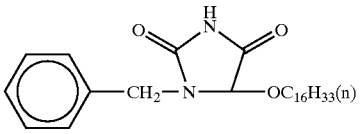

Color Image Stabilizer (Cpd-18):

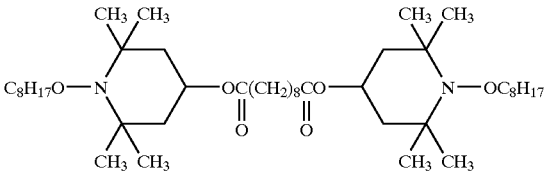

Color Stain Preventing Agent (Cpd-19):

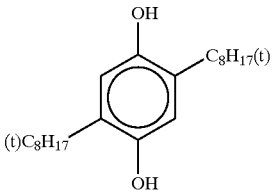

Ultraviolet Absorber (UV-1):

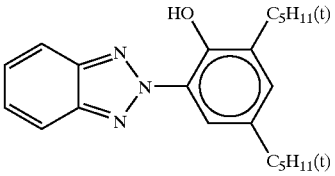

Ultraviolet Absorber (UV-2):

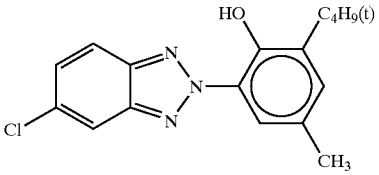

Ultraviolet Absorber (UV-3):

-continued

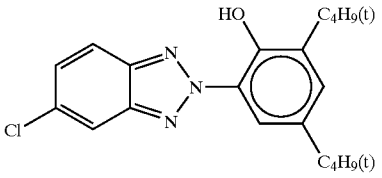

Ultraviolet Absorber (UV-4):

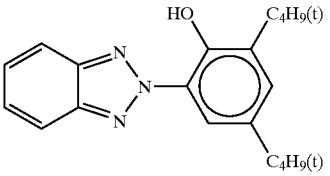

Ultraviolet Absorber (UV-5):

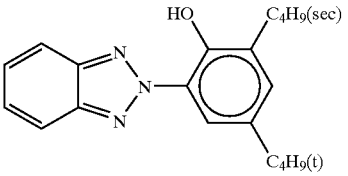

Ultraviolet Absorber (UV-6):

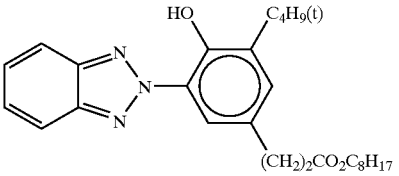

Ultraviolet Absorber (UV-7)

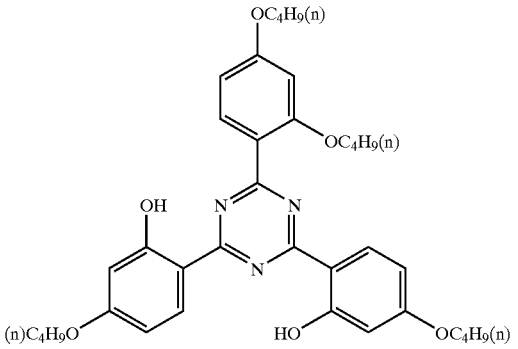

UV-A: A 4/2/2/3 mixture (molar ratio) of UV-1/UV-2/UV-3/UV-4
UV-B: A 9/3/3/4/5/3 mixture (molar ratio) of UV-1/UV-2/UV-3/UV-4/UV-5/UV-6
UV-C: A 1/1/1/2 mixture (molar ratio) of UV-2/UV-3/UV-6/UV-7
(Solv-1)

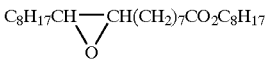

(Solv-2)

-continued

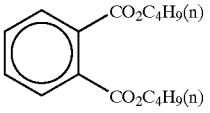

(Solv-3)

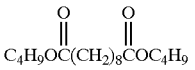

(Solv-4)

(Solv-5)

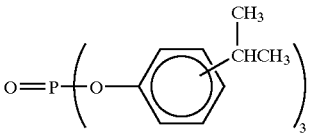

(Solv-7)

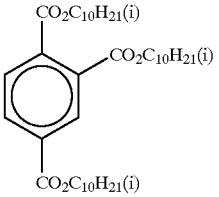

(Solv-8)

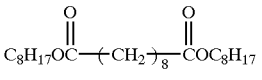

(S1-4)

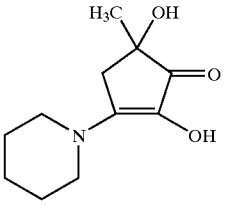

Samples (102) to (111) were prepared in the same manner as with sample (101) with the exception that emulsion 1—1 was changed to emulsions 1-2 to 1-11, respectively.

In order to examine the photographic characteristics of these samples, the following experiment was carried out.

Experiment 1: Sensitometry

Using a sensitometer (Type FWH, manufactured by Fuji Photo Film Co., Ltd., gradation exposure for sensitometry was given to each coated sample. An SP-1 filter was attached, and the sample was exposed at low illuminance for 10 seconds.

Further, using a sensitometer for high illuminance exposure (Type HIE, manufactured by Yamashita Denso Co., Ltd., gradation exposure for sensitometry was given. An SP-1 filter was attached, and the sample was exposed at high illuminance for $10^{-4}$ second.

After exposure, the following color development processing A was conducted.

Processing stages are shown below.

[Processing A]

The above-mentioned sample (101) was processed to a roll form with a width of 127 mm, and exposed imagewise using a mini-laboratory printer processor PP1258AR manufactured by Fuji Photo Film Co., Ltd. Then, continuous processing (running test) was conducted according to the following processing stages until twice the color development tank volume was replenished. Processing using this running solution was named processing A.

| Processing Stage | Temperature | Time | Replenishment Rate* |
|---|---|---|---|
| Color Development | 38.5° C. | 45 sec. | 45 ml |
| Bleaching-Fixing | 38.0° C. | 45 sec. | 35 ml |

-continued

| Processing Stage | Temperature | Time | Replenishment Rate* |
|---|---|---|---|
| Rinsing (1) | 38.0° C. | 20 sec. | — |
| Rinsing (2) | 38.0° C. | 20 sec. | — |
| Rinsing (3)** | 38.0° C. | 20 sec. | — |
| Rinsing (4)** | 38.0° C. | 30 sec. | 121 ml |

*Replenishment rate per $m^2$ of photographic material.

**An RC50D rinse cleaning system manufactured by Fuji Photo Film Co., Ltd. was installed in rinsing (3). A rinsing solution was taken out of rinsing (3) and sent to a reverse osmosis membrane module (RC50D). A transmitted solution obtained in the tank was supplied to rinsing (4), and a concentrated solution was returned to rinsing (3). The pump pressure was adjusted so that the amount of the transmitted solution send to the reverse osmosis membrane module was maintained at 50 to 300 ml/minute, and the solution was circulated under temperature-controlled conditions for 10 hours a day.

Rinsing was carried out as a tank counter current system from (1) to (4).

The composition of each processing solution was as shown below.

| | Tank Solution | Replenisher |
|---|---|---|
| [Color Developing Solution] | | |
| Water | 800 ml | 800 ml |
| Dimethylpolysiloxane (Silicone KF351A manufactured by Shin-Etsu Chemical Co., Ltd. | 0.1 g | 0.1 g |
| Tri(isopropanol)amine | 8.8 g | 8.8 g |
| Ethylenediaminetetraacetic Acid | 4.0 g | 4.0 g |
| Polyethylene Glycol (molecular weight: 300) | 10.0 g | 0.0 g |
| Sodium 4,5-Dihydroxybenzene-1,3-dislulfonate | 0.5 g | 0.5 g |
| Potassium Chloride | 10.0 g | — |
| Potassium Bromide | 0.040 g | 0.010 g |
| Triazinylaminostilbene Fluorescent Brightening Agent (Hakkol FWA-SF manufactured by Showa Chemical Industry Co., Ltd.) | 2.5 g | 5.0 g |
| Sodium Sulfite | 0.1 g | 0.1 g |
| Disodium-N,N-bis(sulfonatoethyl)hydroxylamine | 8.5 g | 1.1 g |
| N-Ethyl-N-(β-methanesulfonamidoethyl)-3-methyl-4-amino-4-aminoaniline.3/2 Sulfuric Acid.Monohydrate | 5.0 g | 15.7 g |
| Potassium Carbonate | 26.3 g | 26.3 g |
| Water to make | 1000 ml | 1000 ml |
| pH (25° C., adjusted with potassium hydroxide and sulfuric acid) | 10.15 | 12.50 |
| [Bleaching-Fixing Solution] | | |
| Water | 700 ml | 600 ml |
| Ammonium Iron (III) Ethylenediaminetetraacetate | 47.0 g | 94.0 g |
| Ethylenediaminetetraacetic Acid | 1.4 g | 2.8 g |
| m-Carboxybenzenesulfinic Acid | 8.3 g | 16.5 g |
| Nitric Acid (67%) | 16.5 g | 33.0 g |
| Imidazole | 14.6 g | 29.2 g |
| Ammonium Thiosulfate (750 g/liter) | 107.0 ml | 214.0 ml |
| Ammonium Sulfite | 16.0 g | 32.0 g |
| Ammonium Bisulfite | 23.1 g | 46.2 g |
| Water to make | 1000 ml | 1000 ml |
| pH (25° C., adjusted with acetic acid and ammonia) | 6.0 | 6.0 |
| [Rinsing Solution] | | |
| Sodium Chlorinated Isocyanurate | 0.02 g | 0.02 g |
| Deionized Water (conductivity: 5 μs/cm or less) | 1000 ml | 1000 ml |
| pH | 6.5 | 6.5 |

For samples (101) to (111) processed as described above, the yellow color forming density was measured. The fog was determined by the minimum color forming density of the sample. The sensitivity was specified as the reciprocal of the exposure necessary for obtaining the color forming density of the fog+1.0, and indicated by a relative value at the time when the sensitivity of sample (101) developed was taken as 100.

TABLE 2

| Sample No. | Emulsion No. | Dopant | Volume Based on $Cl^-$ (%) | Distance from Ligand Atom (angstrom) | Ionic Conductivity*1 | Relative Sensitivity*2 10 sec Exposure | Relative Sensitivity*2 $10^{-4}$ sec Exposure |
|---|---|---|---|---|---|---|---|
| 101 (Comparison) | 1-1 | — | — | — | 1 | 100 | 100 |
| 102 (Comparison) | 1-2 | $IrCl_6$ | 100 | — | 89 | 94 | 201 |
| 103 (Comparison) | 1-3 | $IrCl_5$(thia)[a] | 217 | 4.51 | 63 | 95 | 227 |
| 104 (Comparison) | 1-4 | $IrCl_5$(thiourea) | 202 | 3.50 | 58 | 95 | 229 |
| 105 (Invention) | 1-5 | $IrCl_5$(S-Me-thiourea) | 248 | 5.10 | 13 | 98 | 235 |
| 106 (Invention) | 1-6 | $IrCl_5(S{=}P(NH_2)_2(OH))$ | 250 | 3.98 | 11 | 100 | 222 |
| 107 (Invention) | 1-7 | $IrCl_5(2,5\text{-}(CH_3)_2\text{-}$ thiadiazole) | 291 | 4.49 | 23 | 98 | 239 |
| 108 (Invention) | 1-8 | $IrCl_5$(5-Cl-thiatriazole) | 230 | 4.27 | 14 | 100 | 238 |
| 109 (Invention) | 1-9 | $IrCl_5(2\text{-}Cl\text{-}5\text{-}CH_3\text{-}$ thiatriazole) | 289 | 4.49 | 19 | 100 | 237 |
| 110 (Invention) | 1-10 | $IrCl_5$(2-Cl-5-F-thiatriazole) | 249 | 3.98 | 17 | 100 | 239 |
| 111 (Invention) | 1-11 | $IrCl_5$(2-Br-5-F-thiatriazole) | 249 | 4.04 | 16 | 100 | 238 |

[a]thia = thiazole
*1indicated by a relative value, taking the ionic conductivity of emulsion 1-1 as 1.
*2indicated by a relative sensitivity, taking the sensitivity of sample 101 as 100.

The results shown in Table 2 reveal that the emulsions using the dopants of the present invention are less desensitized when exposed for 10 seconds than the emulsions using the know dopants, providing emulsions excellent in high intensity reciprocity law characteristics.

Example 2

Emulsion 2–1; Preparation of Cubic Silver Iodobromochloride Sample (Comparison)

A 3% aqueous solution of lime-treated gelatin (1000 ml) was adjusted to pH 5.5 and pCl 11.7, and an aqueous solution containing 2.12 mol of silver nitrate and an aqueous solution containing 2.2 mol of sodium chloride were concurrently added thereto at 45° C. with vigorous stirring. From the time when the addition of silver nitrate reached 80% to the time when it reached 100%, potassium chloride was added with vigorous-mixing so as to give a content of 4.3 mol % per mol of silver halide in a final product. From the time when the addition of silver nitrate reached 80% to the time when it reached 90%, an aqueous solution of $K_4[Ru(CN)_6]$ was added so as to give a Ru content of $3\times10^{-5}$ mol per mol of silver halide in the final product. At the time when the addition of silver nitrate reached 90%, an aqueous solution of potassium iodide was added with vigorous mixing in an amount to give an I content of 0.15 mol % per mol of silver halide in the final product. After desilvering treatment was carried out at 40° C., 168 g of lime-treated gelatin was added to adjust the pH and the pCl to 5.5 and 11.8, respectively. Thus, an emulsion of cubic silver chloride grains having a equivalent sphere diameter of 0.35 $\mu$m and a coefficient of variation of 10% was obtained.

This emulsion was dissolved at 40° C., and sodium thiosulfonate was added thereto in an amount of $2\times10^{-5}$ mol per mol of silver halide. Then, using sodium thiosulfate pentahydrate as a sulfur sensitizer, and (S-2) as a gold sensitizer, ripening was conducted at 60° C. so as to give optimum results. After the temperature was lowered to 40° C., sensitizing dye D was added in an amount of $6\times10^{-4}$ mol per mol of silver halide, 1-phenyl-5-mercaptotetrazole in an amount of $2\times10^{-4}$ mol per mol of silver halide, 1-(5-methylureidophenyl)-5-mercaptotetrazole in an amount of 8×10–4 mol per mol of silver halide, and potassium bromide in an amount of $7\times10^{-3}$ mol per mol of silver halide. The emulsion thus obtained was named emulsion 2–1.

Emulsion 2—2; Preparation of Cubic Silver Iodobromochloride Sample Doped with $[IrCl_5(H_2O)]^{2-}$ (Comparison)

Emulsion 2—2 was prepared in the same manner as with emulsion 2–1 with the exception that $K_2[IrCl_5(H_2O)]$ was added to a layer of 92% to 97% from the center of the grain by the grain volume, in an amount of $5\times10^{-7}$ mol based on the total amount of silver added.

Emulsion 2–3; Preparation of Cubic Silver Iodobromochloride Sample Doped with $[IrCl_6]^{3-}$ (Comparison)

Emulsion 2–3 was prepared in the same manner as with emulsion 2—2 with the exception that $K_2[IrCl_6]$ was added to a layer of 83% to 88% from the center of the grain by the grain volume, in an amount of $5\times10^{-8}$ mol based on the total amount of silver added.

Emulsion 2–4; Preparation of Cubic Silver Iodobromochloride Sample Doped with $[IrCl_5(thia)]^{2-}$ (Comparison)

Emulsion 2–4 was prepared in the same manner as with emulsion 2–3 with the exception that pentachloro(thiazole) iridium was added in place of $K_2[IrCl_6]$ in an amount of $6\times10^{-7}$ mol based on the total amount of silver added.

Emulsion 2–5; Preparation of Cubic Silver Iodobromochloride Sample Doped with $[IrCl_5(thiourea)]^{2-}$ (Comparison)

Emulsion 2–5 was prepared in the same manner as with emulsion 2–3 with the exception that pentachloro(S-methylthiourea)iridium was added in place of $K_2[IrCl_6]$ in an amount of $1\times10^{-6}$ mol based on the total amount of silver added.

Emulsion 2–6; Preparation of Cubic Silver Iodobromochloride Sample Doped with $[IrCl_5(S\text{-}Me\text{-}thiourea)]^{2-}$ (Invention)

Emulsion 2–6 was prepared in the same manner as with emulsion 2–3 with the exception that pentachloro(S-methylthiourea)iridium was added in place of $K_2[IrCl_6]$ in an amount of $1\times10^{-6}$ mol based on the total amount of silver added.

Emulsion 2–7; Preparation of Cubic Silver Iodobromochloride Sample Doped with $[IrCl_5(2,5\text{-}(CH_3)_2\text{-thiadiazole})]^{2-}$ (Invention)

Emulsion 2–7 was prepared in the same manner as with emulsion 2–3 with the exception that pentachloro (diaminohydroxythiophosphonic acid)iridium or pentachloro(2,5-dimethyl-1,3,4-thiadiazole)iridium was added in place of $K_2[IrCl_6]$ in an amount of $2\times10^{-6}$ mol based on the total amount of silver added.

Emulsions 2–8 and 2–9; Preparation of Cubic Silver Iodobromochloride Samples Doped with $[IrCl_5(5\text{-Cl-thiatriazole})]^{2-}$ and $[IrCl_5(2\text{-Cl-5-}CH_3\text{-thiadiazole})]^{2-}$, Respectively (Invention)

Emulsions 2–8 and 2–9 were prepared in the same manner as with emulsion 2-3 with the exception that pentachloro(5-chloro-1,2,3,4-thiatriazole)iridium and pentachloro(2-methyl-5-chloro-1,3,4-thiadiazole)iridium were each added in place of $K_2[IrCl_6]$ in an amount of $6\times10^{-7}$ mol based on the total amount of silver added.

Emulsions 2–10 and 2–11; Preparation of Cubic Silver Iodobromochloride Samples Doped with $[IrCl_5(2\text{-Cl-5-F-thiadiazole})]^{2-}$ and $[IrCl_5(2\text{-Br-5-F-thiadiazole})]^{2-}$, Respectively (Invention)

Emulsions 2–10 and 2–11 were prepared in the same manner as with emulsion 2–3 with the exception that pentachloro(2-chloro-5-fluoro-1,3,4-thiadiazole)iridium and pentachloro(2-bromo-5-fluoro-1,3,4-thiadiazole)iridium were each added in place of $K_2[IrCl_6]$ in an amount of $1\times10^{-6}$ mol based on the total amount of silver added.

Samples (201) to (211) were prepared in the same layer constitution as with Example 1 with the exception that the third layer was replaced by emulsion 2–1 to 2–11, respectively. For these samples, the experiment of Example 1 and the following experiment 2 were carried out.

Experiment 2: Latent Image Stability after Exposure

For each sample, sensitometry was measured changing the time from 1/10-second exposure to processing A, and the difference between the sensitivity at the time when the sample was processed after 7 seconds and the sensitivity after 30 minutes was determined.

The results of these two experiments are sown in Table 3 below.

TABLE 3

| Sample No. | Emulsion No. | Dopant | Relative Sensitivity*1 10 sec Exposure | Relative Sensitivity*1 $10^{-4}$ sec Exposure | Difference in Sensitivity Occurring from Exposure to Processing*2 |
|---|---|---|---|---|---|
| 201 (Comparison) | 2-1 | — | 100 | 100 | 0 |
| 202 (Comparison) | 2-2 | $IrCl_5(H_2O)$ | 100 | 218 | 1 |
| 203 (Comparison) | 2-3 | $IrCl_6$ | 93 | 211 | 45 |
| 204 (Comparison) | 2-4 | $IrCl_5$(thia)[a] | 95 | 229 | 5 |
| 205 (Comparison) | 2-5 | $IrCl_5$(thiourea) | 96 | 230 | 1 |
| 206 (Invention) | 2-6 | $IrCl_5$(S-Me-thiourea) | 98 | 235 | 1 |
| 207 (Invention) | 2-7 | $IrCl_5(2,5\text{-}(CH_3)_2\text{-thiadiazole})$ | 98 | 233 | 0 |
| 208 (Invention) | 2-8 | $IrCl_5$(5-Cl-thiatriazole) | 100 | 240 | 2 |
| 209 (Invention) | 2-9 | $IrCl_5(2\text{-Cl-5-}CH_3\text{-thiatriazole})$ | 99 | 238 | 1 |
| 210 (Invention) | 2-10 | $IrCl_5$(2-Cl-5-F-thiatriazole) | 100 | 240 | 1 |
| 211 (Invention) | 2-11 | $IrCl_5$(2-Br-5-F-thiatriazole) | 100 | 239 | 0 |

[a]thia = thiazole
*1indicated by a relative sensitivity, taking the sensitivity of sample 201 as 100.
*2indicated by the difference in relative sensitivity from exposure to development processing The results show that the emulsions of the present invention do not cause high intensity reciprocity failure between 10-second exposure and $10^{-4}$-second exposure, and stably give the same sensitivity (excellent in latent image stability) even when the time from exposure to processing varies.

Example 3

The layer constitution of the respective samples of Example 2 was changed as shown below to prepare thinly layered samples, thus obtaining samples (301) to (311). For these samples, experiment 1 of Example 1 and experiment 2 of Example 2 were carried out. As a result, similarly to the results of Example 2, the effects of the present invention were observed even in ultra-rapid processing of the thinly layered samples, and good results were obtained. The layer constitution of sample (301) is shown below. In emulsions (302) to (311), emulsion 2–1 of sample (301) was changed to emulsions 2—2 to 2–11, respectively.

Preparation of Sample 301:

| The First Layer: (Blue-Sensitive Emulsion Layer) | |
|---|---|
| Emulsion 1-1 | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |

-continued

| | |
|---|---|
| Color Image Stabilizer (Cpd-8) | 0.02 |
| Solvent (Solv-1) | 0.21 |
| The Second Layer: (Color Stain Preventing Layer) | |
| Gelatin | 0.60 |
| Color Stain Preventing Agent (Cpd-19) | 0.09 |
| Color Image Stabilizer (Cpd-5) | 0.007 |
| Color Image Stabilizer (Cpd-7) | 0.007 |
| Ultraviolet Absorber (UV-C) | 0.05 |
| Solvent (Solv-5) | 0.11 |
| The Third Layer: (Green-Sensitive Emulsion Layer) | |
| Emulsion 2-1 | 0.14 |
| Gelatin | 0.73 |
| Magenta Coupler (ExM) | 0.15 |
| Ultraviolet Absorber (UV-A) | 0.05 |
| Color Image Stabilizer (Cpd-2) | 0.02 |
| Color Image Stabilizer (Cpd-7) | 0.008 |
| Color Image Stabilizer (Cpd-8) | 0.07 |
| Color Image Stabilizer (Cpd-9) | 0.03 |
| Color Image Stabilizer (Cpd-10) | 0.009 |
| Color Image Stabilizer (Cpd-11) | 0.0001 |
| Solvent (Solv-3) | 0.06 |
| Solvent (Solv-4) | 0.11 |
| Solvent (Solv-5) | 0.06 |
| The Fourth Layer: (Color Stain Preventing Layer) | |
| Gelatin | 0.48 |
| Color Stain Preventing Agent (Cpd-4) | 0.07 |
| Color Image Stabilizer (Cpd-5) | 0.006 |
| Color Image Stabilizer (Cpd-7) | 0.006 |
| Ultraviolet Absorber (UV-C) | 0.04 |
| Solvent (Solv-5) | 0.09 |
| The Fifth Layer: (Red-Sensitive Emulsion Layer) | |
| Emulsion 2-1 | 0.12 |
| Gelatin | 0.59 |
| Cyan Coupler (ExC-2) | 0.13 |
| Cyan Coupler (ExC-3) | 0.03 |
| Color Image Stabilizer (Cpd-7) | 0.01 |
| Color Image Stabilizer (Cpd-9) | 0.04 |
| Color Image Stabilizer (Cpd-15) | 0.19 |
| Color Image Stabilizer (Cpd-18) | 0.04 |
| Ultraviolet Absorber (UV-7) | 0.02 |
| Solvent (Solv-5) | 0.09 |
| The Sixth Layer: (Ultraviolet Absorbing Layer) | |
| Gelatin | 0.32 |
| Ultraviolet Absorber (UV-C) | 0.42 |
| Solvent (Solv-7) | 0.08 |
| The Seventh Layer: (Protective Layer) | |
| Gelatin | 0.70 |
| Acrylic Modified Copolymer of Polyvinyl Alcohol (degree of modification: 17%) | 0.04 |

-continued

| | |
|---|---|
| Liquid Paraffin | 0.01 |
| Surfactant (Cpd-13) | 0.01 |
| Polydimethylsiloxane | 0.01 |
| Silicon Dioxide | 0.003 |

Each sample thus obtained was exposed in the same manner as with experiment 1 of Example 1, and subjected to color development processing (ultra-rapid processing) according to processing B shown below.

[Processing B]

Each sample described above was processed to a roll form with a width of 127 mm, and exposed imagewise from a negative film having an average density, using an experimental processor obtained by converting a mini-laboratory printer processor PP350 manufactured by Fuji Photo Film Co., Ltd. so that the processing time and the processing temperature are changeable. Then, continuous processing (running test) was conducted according to the following processing stages until the volume of a color developing replenisher used reached 0.5 time the color development tank volume.

| Processing Stage | Temperature | Time | Replenishment Rate* |
|---|---|---|---|
| Color Development | 45.0° C. | 15 sec. | 45 ml |
| Bleaching-Fixing | 40.0° C. | 15 sec. | 35 ml |
| Rinsing (1) | 40.0° C. | 8 sec. | — |
| Rinsing (2) | 40.0° C. | 8 sec. | — |
| Rinsing (3)** | 40.0° C. | 8 sec. | — |
| Rinsing (4)** | 38.0° C. | 8 sec. | 121 ml |
| Drying | 80° C. | 15 sec. | |

*Replenishment rate per $m^2$ of photographic material.

**An RC50D rinse cleaning system manufactured by Fuji Photo Film Co., Ltd. was installed in rinsing (3). A rinsing solution was taken out of rinsing (3) and sent to a reverse osmosis membranemodule (RC50D). A transmitted solution obtained in the tank was supplied to rinsing (4), and a concentrated solution was returned to rinsing (3). The pump pressure was adjusted sothat the amount of the transmitted solution send to the reverse osmosis membrane module was maintained at 50 to 300 ml/minute, and the solution was circulated under temperature-controlled conditions for 10 hours a day.

Rinsing was carried out as a tank counter current system from (1) to (4).

The composition of each processing solution was as shown below.

| | Tank Solution | Replenisher |
|---|---|---|
| [Color Developing Solution] | | |
| Water | 800 ml | 600 ml |
| Fluorescent Brightening Agent (FL-1) | 5.0 g | 5.0 g |
| Tri(isopropanol)amine | 8.8 g | 8.8 g |
| Sodium p-Toluenesulfonate | 20.0 g | 20.0 g |
| Ethylenediaminetetraacetic Acid | 4.0 g | 4.0 g |
| Sodium Sulfite | 0.10 g | 0.50 g |
| Potassium Chloride | 10.0 g | — |
| Sodium 4,5-Dihydroxybenzene-1,3-dislulfonate | 0.50 g | 0.50 g |
| Disodium-N,N-bis(sulfonatoethyl)hydroxylamine | 8.5 g | 14.5 g |
| 4-Amino-3-methyl-N-ethyl-N-(β-methanesulfonamidoethyl)-aniline.3/2 Sulfuric Acid.Monohydrate | 10.0 g | 22.0 g |
| Potassium Carbonate | 26.3 g | 26.3 g |

-continued

| | Tank Solution | Replenisher |
|---|---|---|
| Water to make | 1000 ml | 1000 ml |
| pH (25° C., adjusted with sulfuric acid and KOH) | 10.35 | 12.6 |
| [Bleaching-Fixing Solution] | | |
| Water | 800 ml | 800 ml |
| Ammonium Thiosulfate (750 g/liter) | 107 ml | 214 ml |
| Succinic Acid | 29.5 g | 59.0 g |
| Ammonium Iron (III) Ethylenediaminetetraacetate | 47.0 g | 94.0 g |
| Ethylenediaminetetraacetic Acid | 1.4 g | 2.8 g |
| Nitric Acid (67%) | 17.5 g | 35.0 g |
| Imidazole | 14.6 g | 29.2 g |
| Ammonium Sulfite | 16.0 g | 32.0 g |
| Potassium Metabisulfite | 23.1 g | 46.2 g |
| Water to make | 1000 ml | 1000 ml |
| pH (25° C., adjusted with nitric acid and aqueous ammonia) | 6.5 | 6.5 |
| [Rinsing Solution] | | |
| Sodium Chlorinated Isocyanurate | 0.02 g | 0.02 g |
| Deionized Water (conductivity: 5 μs/cm or less) | 1000 ml | 1000 ml |
| pH (25° C.) | 6.5 | 6.5 |

FL-1

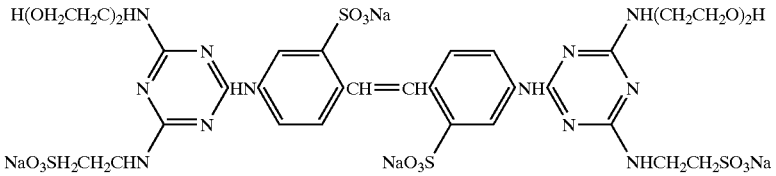

Example 4

Using samples (301) to (311), image formation was conducted by laser scanning exposure. As laser beam sources, there were used 473 nm taken out by wavelength conversion of a YAG solid laser (oscillation wavelength: 946 nm) using a semiconductor laser GaAlAs (oscillation wavelength: 808.5 nm) as an excitation light source with an SHG crystal of $LiNbO_3$ having a inverted domain structure, 532 nm taken out by wavelength conversion of a YVO4 solid laser (oscillation wavelength: 1064 nm) using a semiconductor laser GaAlAs (oscillation wavelength: 808.7 nm) as an excitation light source with an SHG crystal of $LiNbO_3$ having a inverted domain structure, and AlGaInP (oscillation wavelength: about 680 nm; Type No. LN9R20 manufacture by Matsushita Electric Industrial Co., Ltd.) The respective laser beams of three colors were moved perpendicularly to the scanning direction with a polygon mirror to make it possible to conduct scanning exposure in turn on each sample. The fluctuations of the amount of light caused by the temperature of the semiconductor laser was suppressed by keeping the temperature constant utilizing a Berche code. The effective beam diameter was 80 μm, the scanning pitch was 42.3 μm (600 dpi), and the average exposure time per pixel was $1.7\times10^{-7}$ seconds.

After exposure, the samples were processed by color development processing B. Results revealed that the samples of the present invention showed a high sensitivity compared to the samples for comparison, similarly to the results of high intensity exposure of Example 3, to be suitable also for image formation using laser scanning exposure.

According to the present invention, as the ligand of the metal complex, there is used a ligand bulky in the axis direction of the complex, thereby making it possible to obtain the emulsion improved in reciprocity failure over a wide range of exposure illuminations without desensitization and decrease of contrast, and not deteriorating latent image keeping quality.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A light-sensitive silver halide grain containing at least one metal complex having in a ligand a site which can form a covalent bond, a dative bond, an ionic bond, or a bond in a mixed form of a covalent bond, a dative bond, and an ionic bond with a silver ion, wherein when an a-axis, a b-axis and a c-axis of a silver halide crystal lattice are each established taking as an origin a central metal of the metal complex contained in the silver halide grain, the site in the ligand can interact with the silver ion on a lattice point which does not exist on any of the a-axis, the b-axis and the c-axis.

2. The light-sensitive silver halide grain as in claim 1, wherein the ligand is a ligand which has a volume of 220% to 300% based on the volume of a chloride ion $Cl^-$, and in which the distance from an atom in the ligand coordinated to the central metal of the metal complex to an atom in the ligand farthest away is 5.1 angstroms or less.

3. The light-sensitive silver halide grain as in claim 2, wherein the ligand is a ligand which has a volume of 220% to 265% based on the volume of a chloride ion $Cl^-$, and in which the distance from an atom in the ligand coordinated to the central metal of the metal complex to an atom in the ligand farthest away is 4.7 angstroms or less.

4. The light-sensitive silver halide grain as in claim 1, wherein the interactable site in the ligand is from 2.5 angstroms to 4.0 angstroms apart from the silver ion on the lattice point which does not exist on any of the a-axis, the b-axis and the c-axis.

5. The light-sensitive silver halide grain as in claim 1, wherein the metal complex has at least one asymmetric ligand, and a substituent group in the ligand occupies a position of a silver ion adjacent to the asymmetric ligand.

6. The light-sensitive silver halide grain as in claim 1, wherein the ionic conductivity of the silver halide grain at the time when the metal complex is incorporated into the silver halide grain in an amount of $1\times10^{-4}$ mol per mol of silver is 50 times or less that of the silver halide grain into which no metal ion or no metal complex is introduced.

7. The light-sensitive silver halide grain as in claim 6, wherein the ionic conductivity of the silver halide grain at the time when the metal complex is incorporated into the silver halide grain in an amount of $1\times10^{-4}$ mol per mol of silver is 30 times or less that of the silver halide grain into which no metal ion or no metal complex is introduced.

8. The light-sensitive silver halide grain as in claim 1, wherein the metal complex incorporated into the silver halide grain has a charge more positive than −3.

9. The light-sensitive silver halide grain as in claim 1, wherein the silver halide grain has an illumination conversion time of 5 seconds or less.

10. The light-sensitive silver halide grain as in claim 1, wherein the metal complex is a transition metal complex.

11. The light-sensitive silver halide grain as in claim 1, wherein the ligand is an organic compound having 3 or less carbon atoms or an inorganic compound.

12. The light-sensitive silver halide grain as in claim 1, wherein the metal complex is an iridium complex.

13. The light-sensitive silver halide grain as in claim 1, wherein the metal complex contains at least one ligand selected from the group consisting of a thiadiazole compound, a thiatriazole compound, an oxadiazole compound and a triazole compound.

14. The light-sensitive silver halide grain as in claim 1, wherein the ligand of the metal complex contains phosphorus.

15. The light-sensitive silver halide grain as in claim 1, wherein the ligand of the metal complex has an N—C—S bond.

16. The light-sensitive silver halide grain as in claim 1, wherein the silver halide grain is mainly composed of silver chloride.

17. The light-sensitive silver halide grain as in claim 1, wherein the silver halide grain has a silver bromide-containing layer, and the metal complex is contained in the silver bromide-containing layer.

18. The light-sensitive silver halide grain as in claim 17, wherein the silver bromide-containing layer has a silver bromide content of 5 mol % to 50 mol %.

19. The light-sensitive silver halide grain as in claim 16, wherein the silver halide grain has a silver chloride content of 89 mol % to 99.7 mol %, a silver bromide content of 0.25 mol % to 10 mol %, and a silver iodide content of 0.05 mol % to 1 mol %.

20. A silver halide emulsion containing at least one light-sensitive silver halide grain defined in claim 1.

* * * * *